US009826799B2

(12) United States Patent
Dojan et al.

(10) Patent No.: US 9,826,799 B2
(45) Date of Patent: Nov. 28, 2017

(54) UPPERS AND ARTICLES INCORPORATING SAME

(71) Applicant: NIKE, Inc., Beaverton, OR (US)

(72) Inventors: Frederick J. Dojan, Vancouver, WA (US); Shane S. Kohatsu, Beaverton, OR (US); Ruzica Krstic, Beaverton, OR (US); Chin-Chen Huang, Taichung (TW); Benjamin Nethongkome, Beaverton, OR (US); Dolores S. Thompson, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 80 days.

(21) Appl. No.: 13/830,542

(22) Filed: Mar. 14, 2013

(65) Prior Publication Data

US 2014/0259760 A1 Sep. 18, 2014

(51) Int. Cl.

| | |
|---|---|
| ***A43C 11/00*** | (2006.01) |
| ***A43B 23/00*** | (2006.01) |
| ***A43B 23/02*** | (2006.01) |
| ***A43B 1/04*** | (2006.01) |

(52) U.S. Cl.

CPC ..... *A43B 23/026* (2013.01); *A43B 1/04* (2013.01); *A43B 23/0225* (2013.01); *A43B 23/0255* (2013.01); *A43B 23/0265* (2013.01); *A43B 23/0275* (2013.01)

(58) Field of Classification Search

CPC ..... A43B 23/026; A43B 23/0255; A43B 23/0225; A43B 23/027; A43B 23/0275; A43B 1/04; D10B 2501/043

USPC ... 36/50.1, 45, 88, 185, 188, 3 A, 47, 146 C

See application file for complete search history.

(56) References Cited

U.S. PATENT DOCUMENTS

| | | | | | |
|---|---|---|---|---|---|
| 301,333 | A | * | 7/1884 | Brown | A43B 21/32 36/50.1 |
| 2,147,197 | A | * | 2/1939 | Glidden | A43B 1/02 36/3 A |
| 3,574,958 | A | * | 4/1971 | Martuch | A43B 13/226 36/116 |
| 4,069,602 | A | | 1/1978 | Kremer et al. | |
| D293,966 | S | * | 2/1988 | Baungratz | D2/916 |
| 4,735,003 | A | | 4/1988 | Dykeman | |
| 4,756,098 | A | * | 7/1988 | Boggia | 36/114 |
| 5,029,376 | A | * | 7/1991 | Sharp, Jr. | 29/234 |
| 5,152,082 | A | * | 10/1992 | Culpepper | 36/89 |

(Continued)

OTHER PUBLICATIONS

International Search Report and Written Opinion for PCT/US2014/027066 dated Jul. 16, 2014.

*Primary Examiner* — Katharine Gracz
(74) *Attorney, Agent, or Firm* — Banner & Witcoff, Ltd.

(57) ABSTRACT

A composite shell for an upper may include a base layer and a fiber-reinforced layer. The base layer may comprise a mesh or other type of textile material and may extend at least over sides of a generally foot-shaped interior region of the upper. The fiber-reinforced layer may be at least partially bonded to the base layer. The fiber-reinforced layer may extend at least from a lower portion of the base layer generally corresponding to a footbed perimeter to at least a top portion of the base layer generally corresponding to part of an instep region. The fiber-reinforced layer may include a plurality of strips extending from the lower portion to the top portion, the strips separated by inter-strip gaps in the fiber-reinforced layer.

28 Claims, 15 Drawing Sheets

(56) References Cited

U.S. PATENT DOCUMENTS 5,765,297 A 6/1998 Cooper et al.
5,878,512 A 3/1999 Cooper et al.
5,896,683 A * 4/1999 Foxen ..... A43B 7/20 36/89
5,950,335 A * 9/1999 Okajima ..... A43B 5/0401 36/115
5,979,081 A 11/1999 Vaz
6,003,247 A 12/1999 Steffe
6,151,804 A 11/2000 Hieblinger
6,170,175 B1 * 1/2001 Funk ..... 36/89
6,558,784 B1 5/2003 Norton et al.
D479,392 S * 9/2003 Hillyer ..... D2/972
D511,883 S * 11/2005 Matis ..... D2/969
6,986,183 B2 1/2006 Delgorgue et al.
7,040,042 B2 5/2006 Light
7,140,127 B2 11/2006 Yang
D580,155 S * 11/2008 Banik ..... D2/969
7,540,097 B2 * 6/2009 Greene ..... A43B 9/00 36/3 A
D605,842 S * 12/2009 Andersen ..... D2/969
7,941,942 B2 5/2011 Hooper et al.
8,001,704 B2 * 8/2011 Baudouin ..... A43B 7/1495 36/102
8,065,818 B2 * 11/2011 Greene ..... A43B 9/00 12/142 E
D667,620 S * 9/2012 Lonigan ..... D2/969
8,321,984 B2 12/2012 Dojan et al.
2001/0015023 A1 8/2001 Funk
2001/0055684 A1 * 12/2001 Davis ..... A43B 23/0255 428/379
2003/0041395 A1 3/2003 Lin et al.
2004/0049950 A1 3/2004 Van Horne
2004/0205982 A1 * 10/2004 Challe ..... A43B 9/02 36/55
2005/0210709 A1 9/2005 Labonte
2006/0048413 A1 3/2006 Sokolowski et al.
2006/0053662 A1 3/2006 Yang
2006/0064904 A1 3/2006 Confortin et al.
2006/0264136 A1 11/2006 Chiantese
2007/0043630 A1 2/2007 Lyden
2007/0101615 A1 5/2007 Munns
2007/0101616 A1 5/2007 Munns
2007/0113427 A1 5/2007 Mansfield
2007/0180730 A1 * 8/2007 Greene ..... A43B 9/00 36/3 A
2008/0083138 A1 * 4/2008 Lacorazza ..... A43B 3/26 36/97
2011/0113648 A1 5/2011 Leick et al.
2011/0197475 A1 * 8/2011 Weidl ..... A43B 1/0009 36/107
2011/0302810 A1 * 12/2011 Borel ..... A43B 1/04 36/114
2012/0011744 A1 * 1/2012 Bell ..... A43B 1/0072 36/91
2012/0198730 A1 * 8/2012 Burch ..... A43B 23/0245 36/30 R
2012/0204448 A1 8/2012 Bracken
2012/0255201 A1 10/2012 Little

* cited by examiner

UPPERS AND ARTICLES INCORPORATING SAME

BACKGROUND

For certain types of shoes, it is sometimes desirable to include regions in an upper that are stiffer and/or less stretchable than other regions and/or that are otherwise reinforced. Such reinforcement is often desirable in footwear intended for use in athletic activities. When moving quickly to one side, for example, players in many sports may push a side of a foot against the interior surface of the upper. Reinforcement in the sides of the upper can help support and stabilize the player foot.

SUMMARY

This Summary is provided to introduce a selection of concepts in a simplified form that are further described below in the Detailed Description. This Summary is not intended to identify key features or essential features of the invention.

In at least some embodiments, an upper may have a composite shell. The composite shell may include a base layer and a fiber-reinforced layer. The base layer may be formed from a mesh or other type of textile material and may extend at least over sides of a generally foot-shaped interior region of the upper. The fiber-reinforced layer may be bonded, at least in part, to the base layer. The fiber-reinforced layer may extend at least from a lower portion of the base layer generally corresponding to a footbed perimeter to at least a top portion of the base layer generally corresponding to part of an instep region. The fiber-reinforced layer may include a plurality of strips extending from the lower portion to the top portion, the strips separated by inter-strip gaps in the fiber-reinforced layer.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1A:
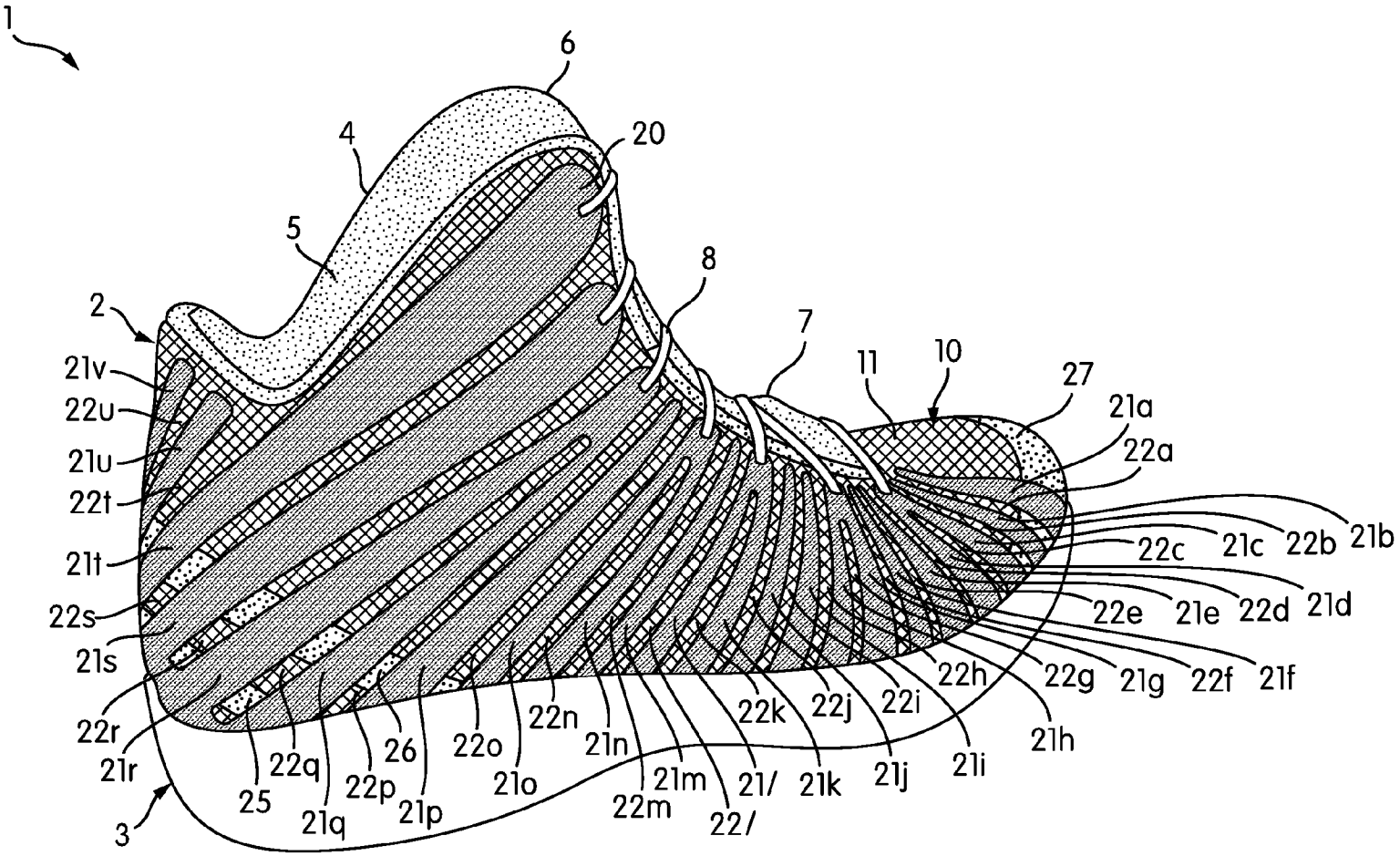
FIG. 1A is a rear lateral perspective view of a shoe incorporating an upper according to some embodiments.

In at least some embodiments, an upper for an article of footwear includes a composite shell. That shell may include a base layer formed from a mesh or other type of textile material. The base layer may be formed from a continuous single element, e.g., an element cut from a larger sheet of textile material. The shell may further include a fiber-reinforced layer bonded, at least in part, to an exterior of the base layer. The fiber-reinforced layer may include multiple strips of fiber reinforced material separated by inter-strip gaps. The strips may include forefoot and/or midfoot region strips that extend across medial and lateral sides of the upper and that may extend into an instep region. The strips may further include heel region strips that extend across heel regions of the upper. The fiber-reinforced layer may itself be a multi-layer composite that includes a bonding layer and a layer of reinforcing fibers. The fiber-reinforcing layer may be formed from one or more continuous elements, e.g., elements cut from a larger sheet of the multi-layer composite. In some embodiments, the fiber-reinforced layer may include several continuous elements, e.g., one element located on the lateral side and on the medial heel side and another element located on the medial side. As explained in further detail below, the number of elements in the fiber-reinforced layer, as well as the number, shape and orientations of the strips and inter-strip gaps, may vary in different embodiments. The materials from which the base and fiber-reinforced layers are formed, as well as other features, may also vary in different embodiments.

Embodiments include uppers, footwear and other foot-receiving devices (e.g., snowboard boots, skates) that incorporate uppers, methods of fabricating uppers, and methods of fabricating footwear incorporating uppers. The following discussion and accompanying figures describe uppers for articles of footwear in accordance with several such embodiments. Shoes incorporating uppers according to various embodiments may have configurations that are suitable for athletic activities such as basketball and soccer. Other embodiments may include footwear adapted for golf, running, walking, hiking and other athletic and nonathletic activities. Persons skilled in the art will recognize that concepts disclosed herein may be applied to a wide range of footwear styles and are not limited to the specific embodiments discussed below and depicted in the figures.

To assist and clarify subsequent description of various embodiments, various terms are defined herein. Unless context indicates otherwise, the following definitions apply throughout this specification (including the claims). "Shoe" and "article of footwear" are used interchangeably to refer to articles intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An interior side, surface, face or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Unless the context indicates otherwise, "top," "bottom," "over," "under," "above," "below," "higher," "lower" and similar locational terms assume that a shoe or shoe structure of interest is in the orientation that would result if the shoe (or shoe incorporating the shoe structure of interest) is in an undeformed condition with its outsole (and/or other ground-contacting sole structure element(s)) resting on a flat horizontal surface. Unless context clearly indicates otherwise, however, the term "upper" refers to the component of a shoe (or other foot-receiving device) that at least partially covers a wearer foot and helps to secure the wearer foot to a shoe sole structure (or to another foot-receiving device element).

Elements of a shoe can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial sides of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial sides of a wearer's midfoot (or portion thereof) when the shoe is worn. As a further example, a heel region of a foot includes the talus and calcaneus bones. A heel element of a shoe is an element having one or more portions located over, under, to the lateral and/or medial sides of, and/or behind a wearer's heel (or portion thereof) when the shoe is worn. The forefoot region may overlap with the midfoot region, as may the midfoot and heel regions.

Figure 1B:
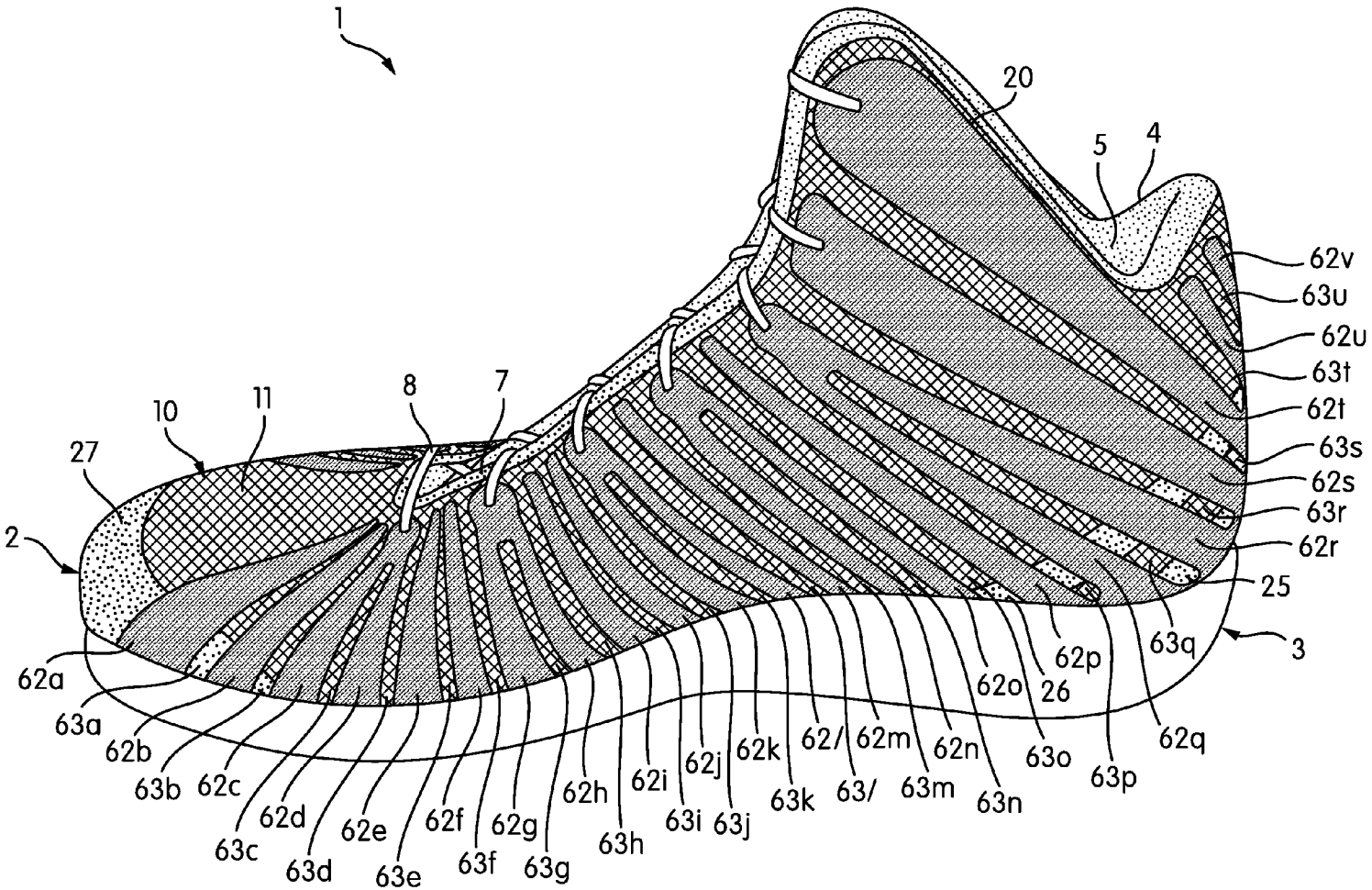
FIG. 1B is a medial side view of the shoe of FIG. 1A.
Figure 1C:
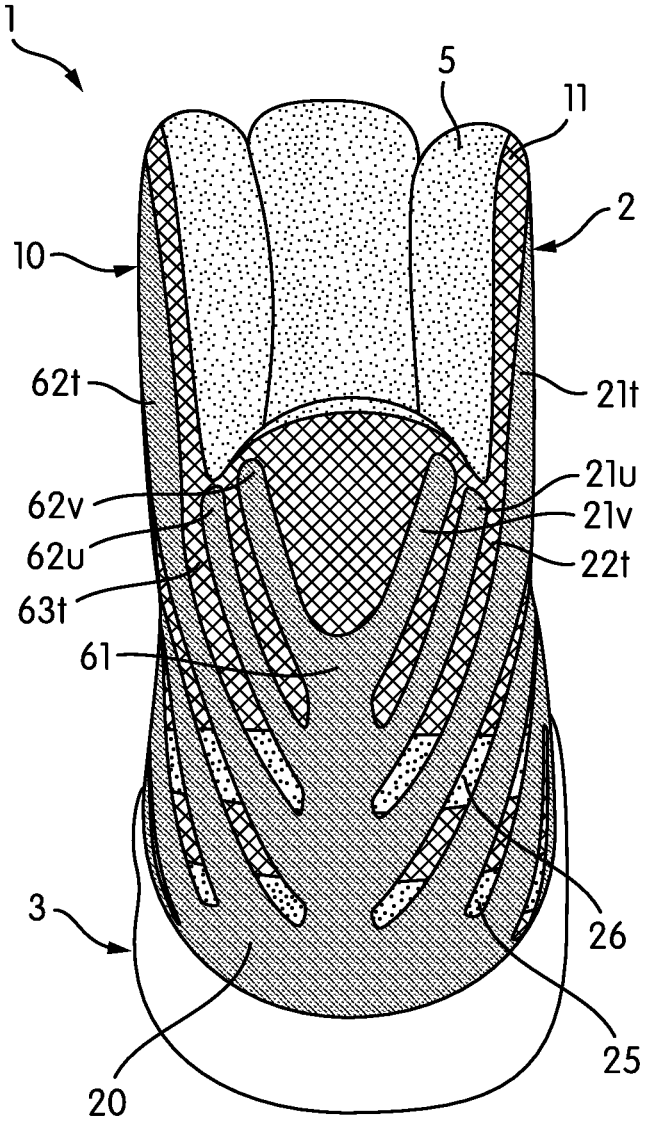
FIGS. 1C and 1D are respective rear and front views of the shoe of FIG. 1A.
Figure 1D:
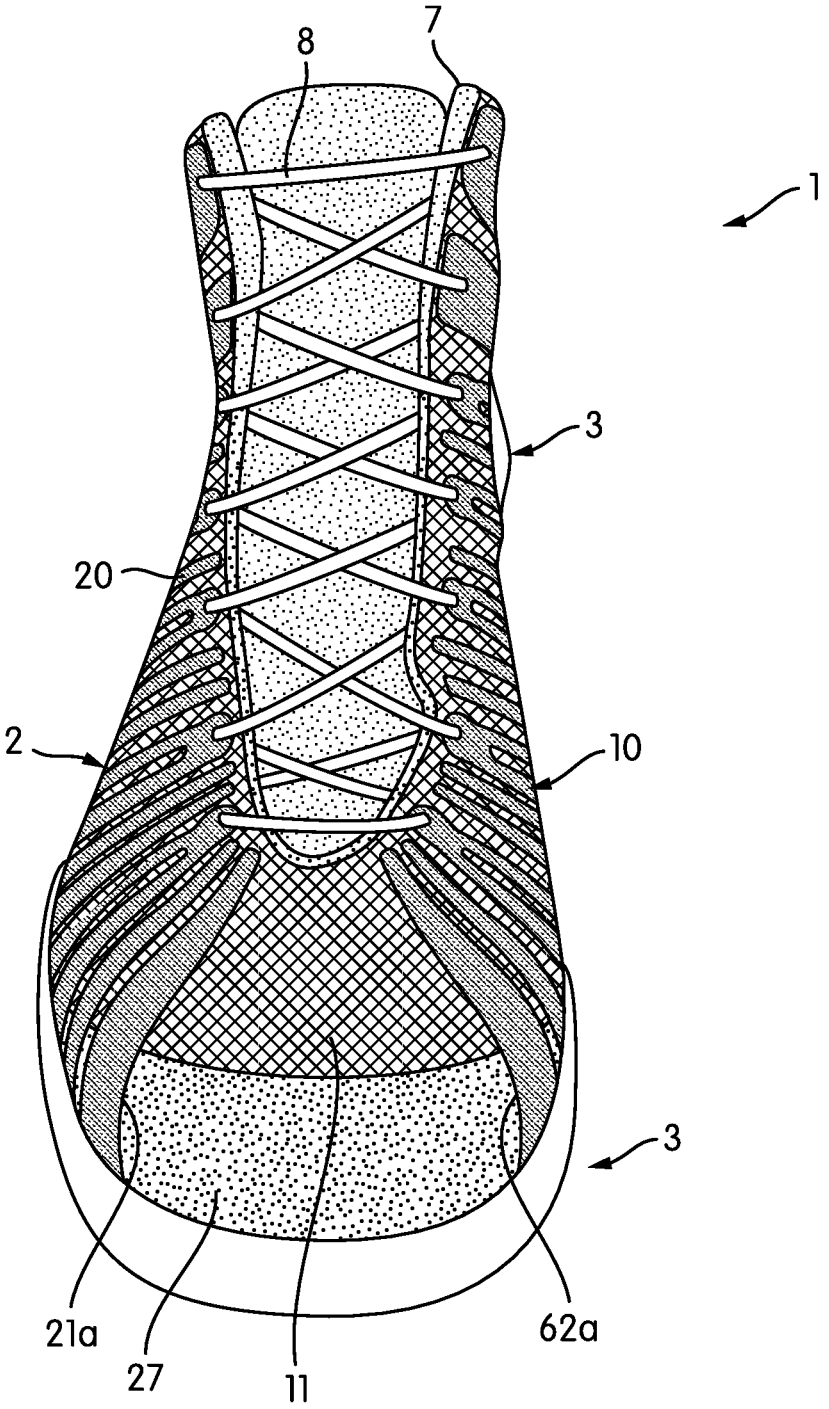

FIG. 1A is a lateral rear perspective view of a shoe 1 that includes an upper 2 according to some embodiments. FIG. 1B is a medial side view of the shoe of FIG. 1A. FIGS. 1C and 1D are respective rear and front views of the shoe of FIG. 1A. Shoe 1 is a right foot shoe and is part of a pair that includes a left foot shoe (not shown) that is a mirror image of shoe 1.

Upper 2 is attached to a sole structure 3. Embodiments include shoes having sole structures of numerous widely varying types. A sole structure in some embodiments may be, e.g., a single piece molded from synthetic rubber or other material. In other embodiments, a sole structure may include multiple components that have been sequentially molded or otherwise joined together. For example, a sole structure may include a midsole formed from a first material (e.g., foamed ethylene vinyl acetate) bonded to an outsole formed from different materials (e.g., synthetic rubber). A sole structure could also include one or more fluid-filled cushions, a stiffening plate or other support element(s), traction elements (e.g., cleats), etc. For convenience, and because of differing internal details of sole structures according to various embodiments, sole structure 3 is treated as a single unitary component in the drawing figures.

Upper 2 forms an interior void that has the general shape of a right foot. The interior void may be accessed (e.g., a foot may be inserted) through ankle opening 4. A padded collar 5 surrounds ankle opening 4 and extends downward into the heel region interior of upper 2. Upper 2 may extend over toe and instep regions, along medial and lateral sides, and around the heel region. Upper 2 may further include a Strobel or other lasting element, not shown, which forms a footbed portion of upper 2. In particular, and as described in further detail below, the lasting element may be stitched or otherwise attached to a lower edge of a shell. The exterior/bottom face of the lasting element may then be glued or otherwise attached to sole structure 3.

Upper 2 includes a tongue 6 situated in a tongue opening 7. Lace 8 passes through multiple lacing eyelets on opposite sides of tongue opening 7. Lace 8 may tightened to selectively change the size of tongue opening 7 and ankle opening 4, thereby permitting a wearer to modify girth and other dimensions of the upper 2 to accommodate feet of varying proportions.

A composite shell 10 forms the main body of upper 2. Shell 10 is joined (e.g., by stitching) to padded collar 5, to tongue 6, and to a lasting element (not visible in FIGS. 1A-1D). Shell 10 includes a textile base layer 11. In the embodiment of upper 2, and with the exception of tongue opening 7, base layer 11 completely surrounds the top and sides of a wearer foot. As described in more detail below, base layer 11 may be formed from a continuous single piece that has been cut from a larger sheet of textile material. In some embodiments, base layer 11 has a mesh construction. In other words, the textile material of base layer 11 is knitted and/or woven so as to form a pattern of closely spaced holes. In at least some embodiments, that mesh material is stretchable in response to tension created by forces imposed during normal wear of shoe 1. The mesh material of base layer 11 may also be relatively soft and compressible in response to such forces.

Shell 10 further includes a fiber-reinforced layer 20. At least portions of fiber-reinforced layer 20 are bonded to base layer 11. As used herein, "bonding" includes bonding through use of glue or other adhesives, through melting and subsequent solidification of a bonding material, and/or through melting and subsequent solidification of a substituent element, but differs from stitching, stapling or similar types of mechanical attachment. Although bonded elements may include incidental stitching or other types of mechanical attachment (e.g., to attach the bonded elements to another element), bonded elements generally do not rely on stitching or other mechanical attachment for their primary structural connection to one another. In at least some embodiments, and as discussed below, fiber-reinforced layer 20 is bonded to base layer 11 using a process similar to that described in commonly-owned U.S. Pat. No. 8,321,984, which patent in its entirety is incorporated by reference herein.

Fiber-reinforced layer 20 is formed from a material that is substantially less stretchable than the material of base layer 11. In particular, fiber-reinforced layer 20 incorporates fibers having relatively high tensile strength and that are bound in a polymer matrix. In the embodiment of upper 2, those fibers comprise woven polyester fibers. In other embodiments, a fiber-reinforced layer may include polyamide (e.g., NYLON) and/or other types of synthetic and/or natural fibers commonly used in textile applications. In still other embodiments, various types of high-tensile strength fibers may be used (e.g., glass fibers, carbon fibers, aramid (e.g., KEVLAR) fibers), etc. As described in further detail below, fiber-reinforced layer 20 may comprise one or more panels that have been cut from a preformed sheet of composite material that includes reinforcing fibers bound in a polymer matrix. As is also described below, panels forming fiber-reinforced layer 20 may be bonded to a panel of material forming base layer 11 in a substantially flat configuration so as to form shell 10. Shell 10 can then be folded and secured to form a complex three-dimensional curved shape.

In regions where they are bonded, the material of fiber-reinforced layer 20 limits stretch in the material of base layer 11. These stretch-limited regions in shell 10 help to secure a wearer foot relative to sole structure 3. These regions also extend across a large portion of shell 10, thereby shaping upper 2 and more comfortably distributing reinforcement (and restraint) across a larger surface area. The structure of shell 10 allows fabrication of a shaped reinforced upper without use of complex three-dimensional molds. For example, the distribution of the stretch limited regions allows shell 10 (and thus, upper 2) to more comfortably conform to a wearer foot. The location of base layer 11 between fiber-reinforced layer 20 and the interior of shoe 1 further increases wearer comfort. In particular, the softer material of base layer 11 helps to cushion the wearer foot from the harder material of layer 20.

Fiber-reinforced layer 20 includes multiple lateral side strips 21 that extend across lateral side and top surfaces of base layer 11. In the embodiment of upper 2, the lateral side of fiber-reinforced layer 20 includes twenty-two strips 21*a* through 21*v*. Strips 21 are separated by inter-strip gaps 22. In FIG. 1A, inter-strip gaps 22*a* through 22*u* are indicated.

Strips 21*a* through 21*q* extend from a lower edge of base layer 11 to locations near the lateral edge of tongue opening 7. Strips 21*r* and 21*s* extend from the heel region to the lateral edge of tongue opening 7. Strips 21*t* through 21*v* branch from a central strip 61 (see FIG. 1C). Strip 21*t* extends to a location near the lateral edge of tongue opening 7. Strips 21*u* and 21*v* extend to locations near a lateral edge of ankle opening 4. In the embodiment of upper 2, each of strips 21*a* through 21*q* extends at least from a location that is at or near the footbed level of upper 2. Strips 21*r* through 21*v* branch from portions of layer 20 that extend at least from locations at or near the footbed level of upper 2. In the embodiment of upper 2, the footbed level corresponds to the attachment of the lasting element to shell 10.

The orientations of strips 21 generally correspond to lines of force imposed during various types of side-to-side motions in which a wearer of shoe 1 may be expected to engage. In particular, strip 21*a* is angled rearward and strip 21*v* is angled forward. The orientations of strips 21*b* through 21*u* progressively vary from a rearwardly angled orientation in the front portion of upper 2 to a forwardly angled orientation in the rear portion of the upper 2.

As seen in FIG. 1B, the medial side of upper 2 is similar to the lateral side. The medial side of fiber-reinforced layer 20 includes multiple strips 62 that extend across medial side and top surfaces of base layer 11. In the embodiment of upper 2, the medial side of fiber-reinforced layer 20 includes twenty-two strips 62*a* through 62*v* separated by inter-strip gaps 63. Strips 62*a* through 62*q* extend from an outer edge of base layer 11 (which corresponds to a lower edge of base layer 11 in a completed upper 2) to locations near the medial edge of tongue opening 7. Strips 62*r* and 62*s* extend from the heel region to the medial edge of tongue opening 7. Strips 62*t* through 62*v* branch from central strip 61. Strip 62*t* extends to a location near the medial edge of tongue opening 7. Strips 62*u* and 62*v* extend to locations near a medial edge of ankle opening 4.

A portion of medial side strips 62 extend at least from locations at or near the footbed level of upper 2. Another portion of medial side strips 62 branch from portions of layer 20 that extend at least from locations at or near the footbed level. The orientations of medial side strips 62 also generally correspond to lines of force imposed during various types of side-to-side motions. Forwardmost medial side strip 62*a* is angled rearward, rearmost medial side strip 62*v* is angled forward, and the orientations of remaining medial side strips 62 progressively vary from a rearwardly angled orientation in the front portion of upper 2 to a forwardly angled orientation in the rear portion of the upper 2.

In at least some embodiments, and as indicated above, shell 10 may be fabricated using a process such as is described in U.S. Pat. No. 8,321,984. In particular, panels of material for base layer 11 and fiber-reinforced layer 20 may assembled in a flat configuration. In that flat assembly, the material panels are arranged so as to have the same relative alignment that will exist in the completed shell. Additional elements may also be included in that assembly. For example, panels of material to form supplemental reinforcements such as counter reinforcements 25 and 26 and toe reinforcement 27 can be placed between the layer 11 and layer 20 panels in appropriate locations. The assembly may then be subjected to a heated pressing between two silicone pads. During that pressing, thermoplastic polyurethane (TPU) on the interior faces of the layer 20 panels melts and flows into the interstices of the layer 11 panel exterior face and of the exterior faces of panels for reinforcements 25-27. Additional TPU between the interior faces of panels for reinforcements 25-27 and the exterior face of the layer 11 panel similarly melts and flows. After the heated pressing, the assembly may be subjected to a second pressing between unheated silicone pads. As the melted and flowed TPU cools, bonds are formed. After the conclusion of the pressing operations, the bonded panels may be subjected to trimming and other finishing operations (e.g., punching of eyelet holes).

In some embodiments, the above-described assembly and pressing operations can be performed using a dual pan assembly jig. Such a jig, as well as associated techniques for using same, are also described in U.S. Pat. No. 8,321,984.

Figure 2A:
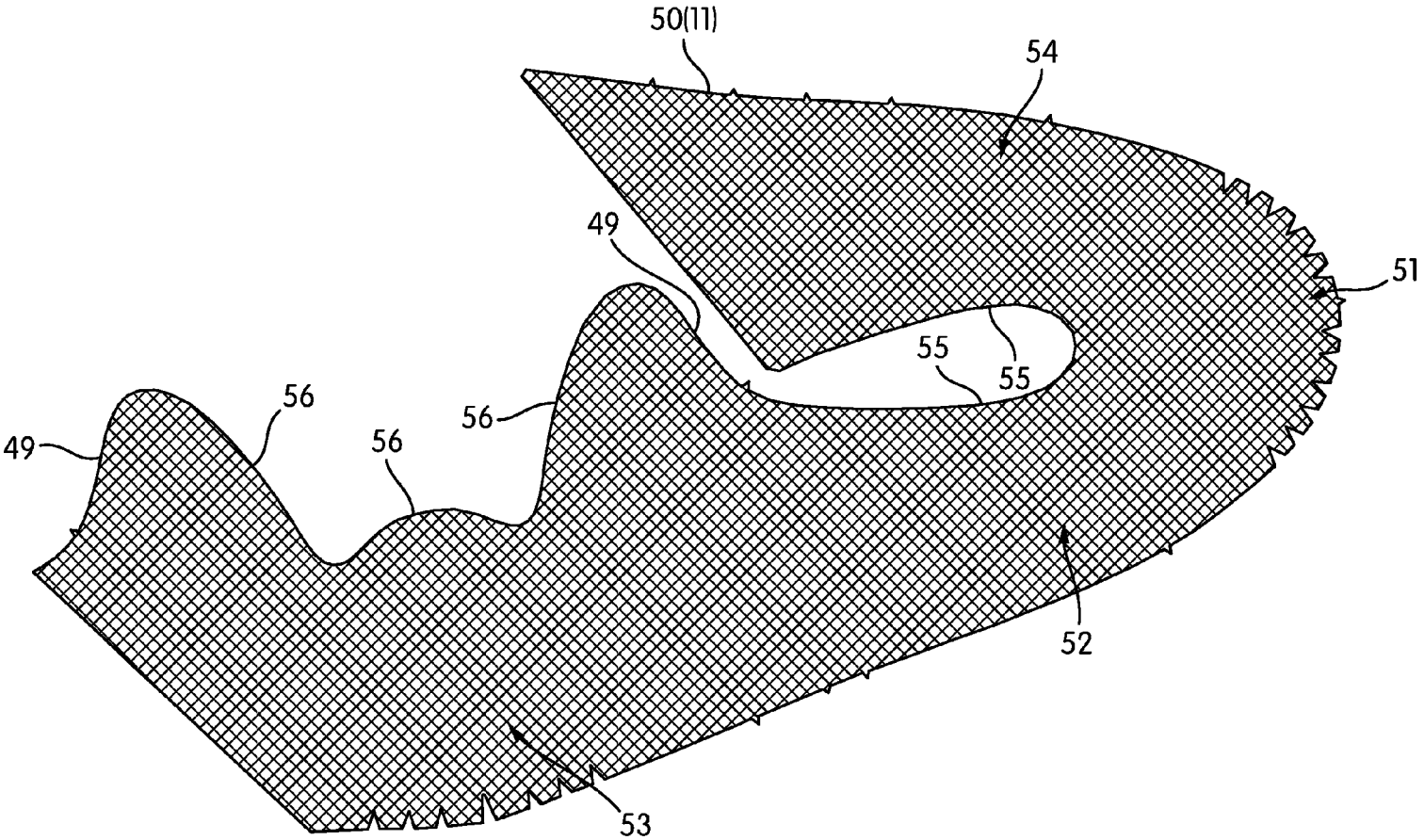
FIGS. 2A through 2C show assembly of components forming a composite shell of the upper incorporated into the shoe of FIGS. 1A through 1D.
Figure 2B:
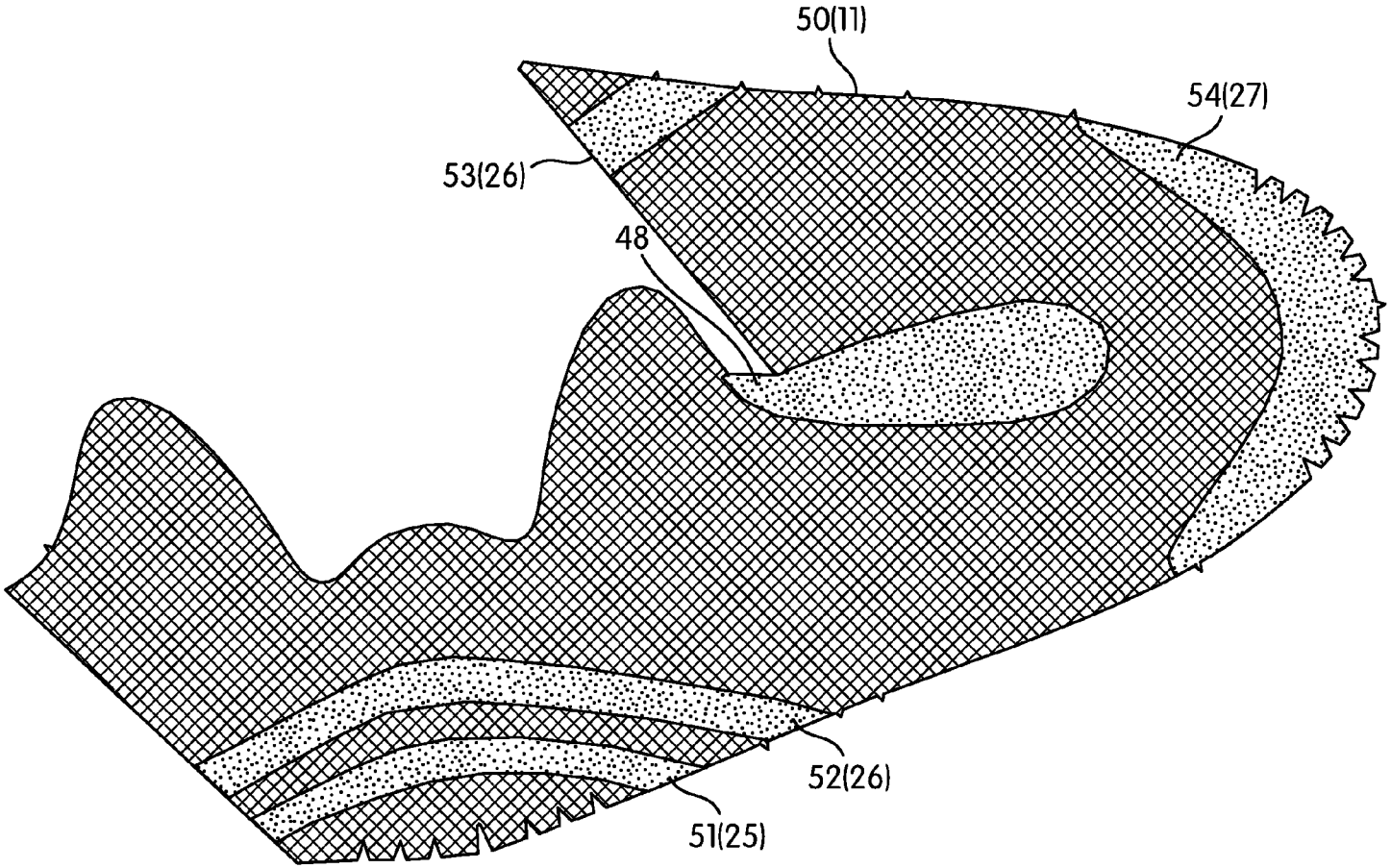
Figure 2C:
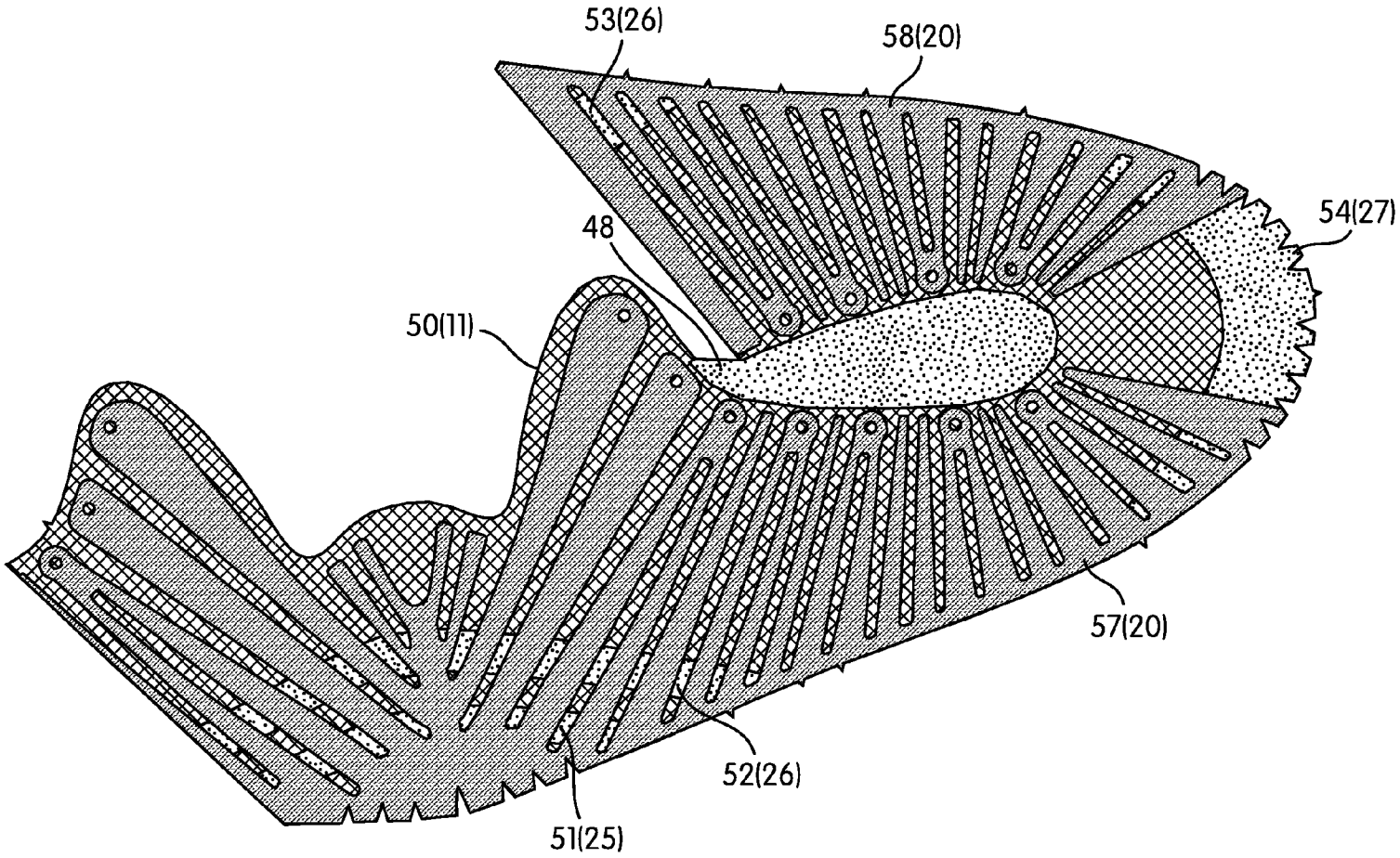

FIGS. 2A through 2C show assembly of the shell 10 components according to at least some embodiments. FIG. 2A shows a panel of material 50 that will form base layer 11. For convenience, reference numbers of certain panels shown in FIGS. 2A-2C will include parentheticals indicating the layer of shell 10 that a particular panel will form or the layer of which a particular panel will become a part. In at least some embodiments, the material of panel 50 is a textile mesh. Examples of such material include knitted polyester meshes, knitted polyester 3D meshes and knitted polyester spacer meshes. Additional examples of base layer material according to some embodiments include woven textiles, woven or knitted textiles having a sock-like weave or knit pattern, non-mesh woven materials and non-mesh knitted materials. In the embodiment of upper 2, the panel 50 is a continuous single piece of material. In particular, the panel 50 material is continuously knitted. Panel 50 may be cut from a larger piece of the continuously knitted textile mesh.

The exterior face of panel 50 is shown in FIG. 2A. For purposes of reference, FIG. 2A further marks certain regions of panel 50. A region 51 will become part of the toe region in upper 2. A region 52 will become part of the lateral forefoot side region of upper 2. A region 53 will become part of the rear of upper 2. A region 54 will become part of the medial forefoot side region of upper 2. An edge 55 will generally correspond to a front portion of tongue opening 7. An edge 56 will generally correspond to ankle opening 4. Edges 49 will generally correspond to rear portions of tongue opening 7.

FIG. 2B shows panel 50 after placement of panels that will form supplemental reinforcements of shell 10. Panels 51 and 52 are placed on the exterior face of panel 50 in a region that will correspond to a heel region of upper 2.

Panels 51 and 52 will respectively become counter reinforcements 25 and 26. A panel 53 will become an end portion of counter reinforcement 26 on the medial side of upper 2. Panel 54 is placed on the exterior face of panel 50 in a region that will become the toe box of upper 2. In addition to providing additional toe region support, panel 54 will provide increased abrasion resistance in the toe region of shoe 1. Panel 48 is placed over the opening in panel 50 that will coincide with tongue opening 7. Panel 48 also extends a short distance beyond edge 55 and over the exterior face of panel 50. As shown in further detail below, a portion of panel 48 over a front portion of tongue opening 7 will later be removed. The remaining portion of panel 48 will surround and reinforce the edge of the front portion of tongue opening 7.

In at least some embodiments, panels 48 and 51-54 are cut from one or more larger pieces of synthetic leather (e.g., 1.2 mm thick synthetic leather). A layer of low melt TPU may be interposed between the interior faces of panels 48 and 51-54 and the regions of the panel 50 exterior face contacted by one of those panels.

FIG. 2C shows the assembly of panels 50-55 after placement of panels that will form fiber-reinforced layer 20. In the embodiment of upper 2, fiber-reinforced layer 20 is formed using two separate panels. In other embodiments, and as described in further detail below, a fiber-reinforced layer may be formed using a single panel. In still other embodiments, more than two panels may be used.

Panel 57 is placed on portions of the exterior faces of panels 50, 51, 52 and 54 in regions that will correspond to lateral forefoot, lateral midfoot, lateral heel and medial heel regions of upper 2. Panel 58 is placed on portions of the exterior faces of panels 50, 53 and 54 in regions that will correspond to medial midfoot and medial forefoot regions of upper 2. As previously indicated, the material of fiber-reinforced layer 20 comprises reinforcing fibers that are bound in a polymer matrix. In some embodiments, panels 57 and 58 are die cut from a continuous preformed sheet of composite material. That composite may include a bonding layer formed from a relatively low-melting TPU, a tensile layer formed from a sheet of woven polyester fiber bound in a polymer matrix (e.g., in a matrix of TPU, thermoset polyurethane (PU) or other polymer) and an abrasion-resistant layer formed from a higher-melting TPU or from PU. The bonding layer material faces of panels 57 and 58 are then used as the interior faces of those panels and are placed into direct contact with the exterior faces of panels 50-54.

Figure 3:
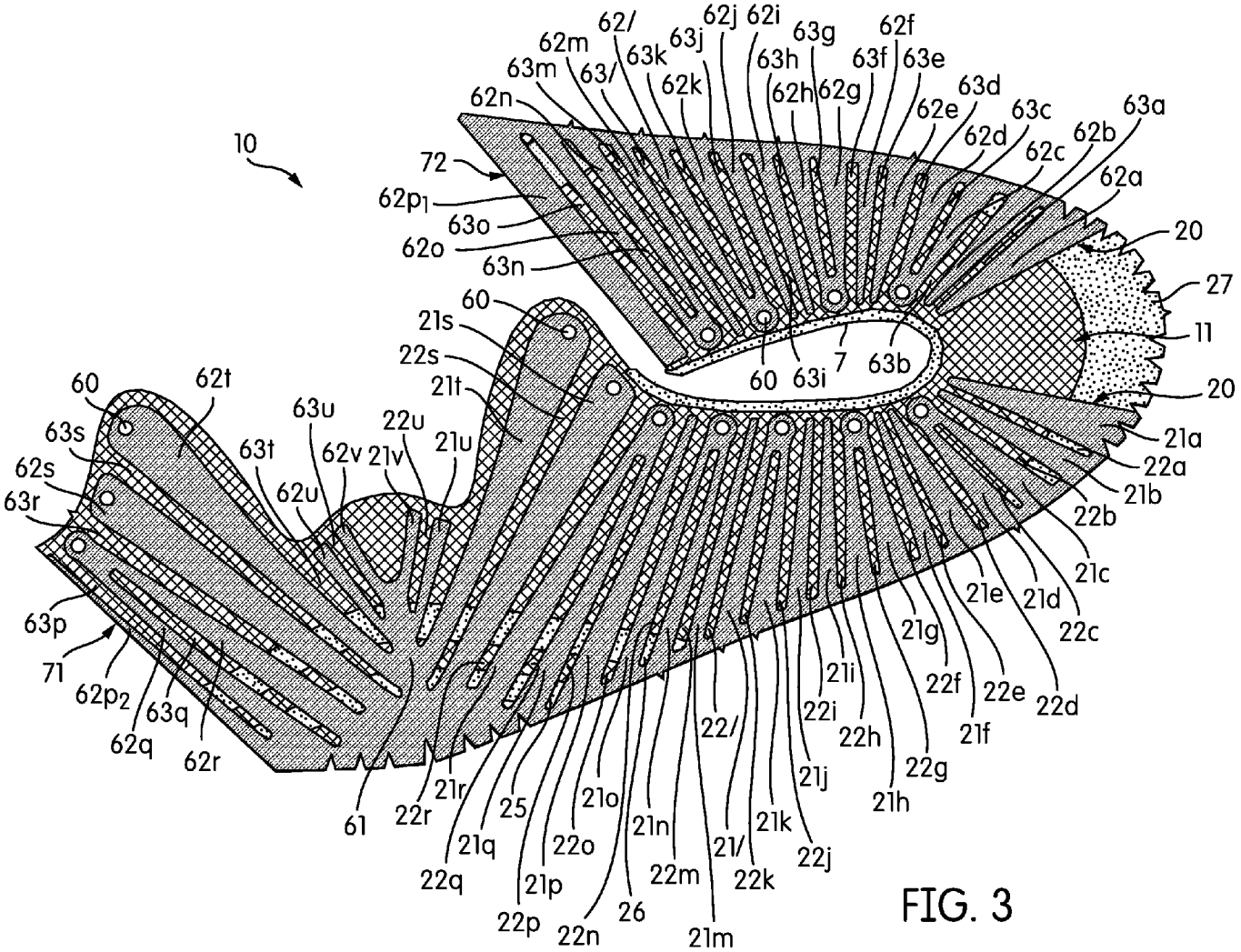
FIG. 3 shows a flattened composite shell prior to incorporation into the upper of the shoe of FIGS. 1A through 1D.

After completion of the panel assembly as shown in FIG. 2C, the assembly is subjected to pressing as previously described. After that pressing, the bonded panel assembly is then trimmed to yield composite shell 10 in a flattened form. FIG. 3 shows flattened composite shell 10 prior to its incorporation into upper 2. A portion of panel 48 has been trimmed to expose the front portion of tongue opening 7. Eyelet holes 60 have also been punched. To avoid obscuring FIG. 3, only a portion of eyelet holes 60 are indicated. Strips 21*a*-21*v*, inter-strip gaps 22*a*-22*s*, strips 62*a*-62*v* and inter-strip gaps 63*a*-63*u* are marked in FIG. 3 so as to show correspondence between regions of shell 10 in flattened form and regions of shell 10 when incorporated into upper 2 (FIGS. 1A-1D).

In subsequent steps, additional components are attached to shell 10 so as to complete upper 2. Padded collar 5 is attached to the region of shell 10 that will form ankle collar 4. Tongue 6 is attached to the interior of shell 10 around the front portion of tongue opening 7. Shell 10 is then folded from a flattened condition into a three-dimensional curved shape and edge 71 is joined to edge 72 using adhesive, stitching and/or another attachment technique. After folding over and securing of edges 71 and 72, strips $\mathbf{62}p_1$ and $\mathbf{62}p_2$ effectively combine to form a single strip 62*p* (see FIG. 1B). The outer edge of shell 10 in its flattened form becomes the bottom edge of shell 10 in its folded form. The outer edge of a Strobel or other lasting element may then be stitched or otherwise secured to (or near) that bottom edge. The completed upper 2 may then be attached to sole structure 3 while upper 2 is secured to a last.

In a completed shoe 1, fiber-reinforced layer 20 of shell 10 provides reinforced regions that cover a substantial portion of the exposed surface area of upper 2. In additional to providing shape to upper 2, this distribution of reinforcement over a wide surface area allows for greater comfort and support. The arrangement of fiber-reinforced layer strips separated by inter-strip gaps allows the fiber-reinforced regions of shell 10 to be easily deformed from a substantially flat condition and into a complex three-dimensional shape of a completed upper 2. Because of their elongated shape and orientation, the strips are able to deform along their lengths by curving and/or twisting so as to provide the proper shape. The inter-strip gaps help to define the elongated shapes of the strips and allow the strips to move relative to one another to a limited degree. Because the strips allow shell 10 to be folded from a flat state to the complex three-dimensional shape of the upper, distributed fiber-reinforced regions can be provided without use of complex-three-dimensional molds.

Figure 4A:
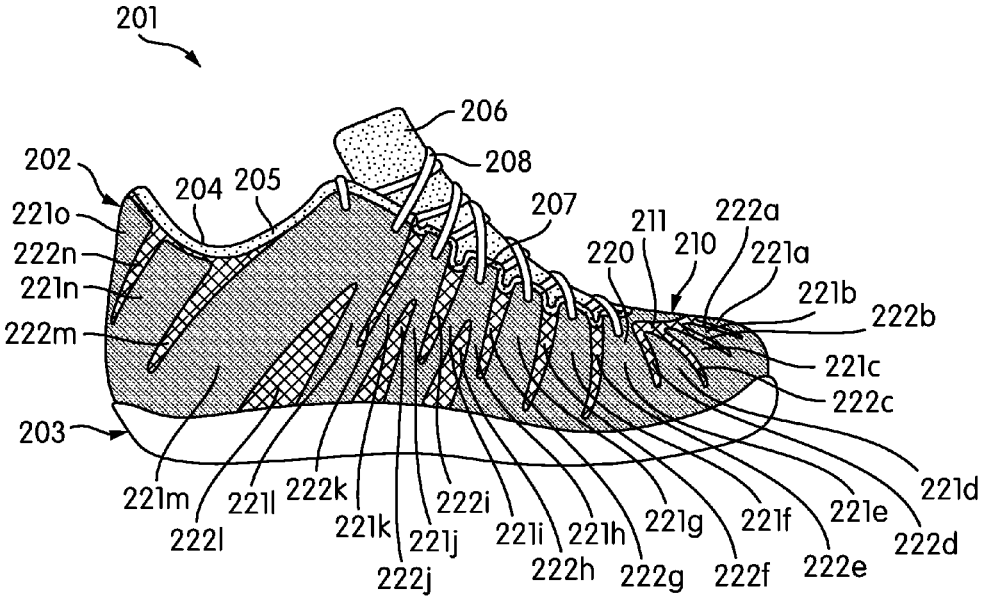
FIGS. 4A and 4B are respective lateral and medial side views of a shoe incorporating an upper according to some additional embodiments.
Figure 4B:
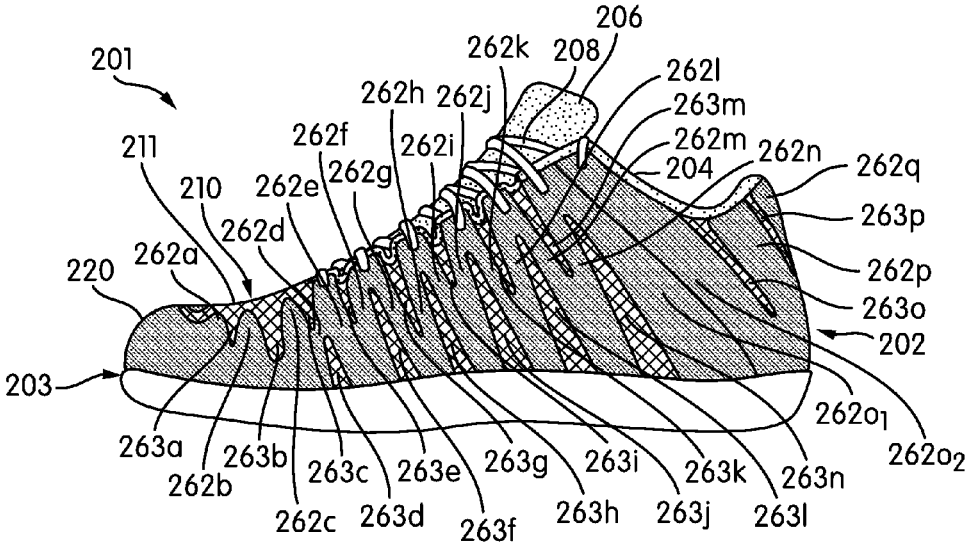

In other embodiments, the number, shapes and locations of reinforcing strips and/or of inter-strip spaces may vary. FIGS. 4A and 4B are respective lateral and medial side views of a shoe 201 that includes an upper 202 according to one such embodiment. Shoe 201 is also a right foot shoe and is part of a pair that includes a left foot shoe (not shown) that is a mirror image of shoe 201. Upper 202 is attached to a sole structure 203. As indicated above, embodiments include shoes having sole structures of numerous widely varying types. In some embodiments, sole structure 203 is a cleated sole structure appropriate for, e.g., soccer. In other embodiments, sole structure 203 may be of other types such as were previously described in connection with shoe 1 and FIG. 1.

Similar to upper 2 of shoe 1, upper 202 forms an interior void having the general shape of a right foot accessible through an ankle opening 204. A padded collar 205 surrounds ankle opening 204 and extends downward into the heel region interior of upper 202. Upper 202 may extend over toe and instep regions, along medial and lateral sides, and around the heel region. Upper 202 may further include a Strobel or other lasting element, not shown, which forms a footbed portion of upper 202. A tongue 206 is situated in a tongue opening 207, with a lace 208 passing through multiple lacing eyelets on opposite sides of tongue opening 207.

A composite shell 210 forms the main body of upper 202. Shell 210 is joined to ankle collar 204, to tongue 206, and to a lasting element (not visible in FIGS. 4A and 4B). Shell 210 includes a textile base layer 211. With the exception of tongue opening 207, base layer 211 completely surrounds the top and sides of a wearer foot. As with base layer 11 in the embodiment of upper 2, base layer 211 may be formed from a continuous single piece that has been cut from a larger sheet of a stretchable mesh textile material.

Shell 210 includes a fiber-reinforced layer 220. Fiber-reinforced layer 220 is at least partially bonded to base layer 211. In at least some embodiments, fiber-reinforced layer 220 is bonded to base layer 211 using a process similar to that described in U.S. Pat. No. 8,321,984. Similar to layers 20 and 11 in upper 2 of shoe 1, fiber-reinforced layer 220 may be formed from a material that is substantially less stretchable than the material of base layer 211. In particular, fiber-reinforced layer 220 may be formed from materials similar or identical to those used to form fiber reinforced layer 20.

Fiber-reinforced layer 220 includes multiple strips 221 that extend across side and top surfaces of base layer 210 on the lateral side. However, the shape, location and number of strips 221 differ from the embodiment of upper 2. For example, the lateral side of fiber-reinforced layer 211 includes fifteen strips 221*a* through 221*o*. Strips 221 are separated by inter-strip gaps 222, the shapes, locations and number of which also vary from the embodiment of upper 2. In FIG. 4A, inter-strip gaps 222*a* through 222*n* are indicated. The medial side of fiber-reinforced layer 211 includes seventeen strips 262*a* through 262*q* separated by inter-strip gaps 263*a*-263*p*. As illustrated by the embodiment of upper 202, the number of strips and inter-strip gaps on the lateral side need not be the same as the number of strips and inter-strip gaps on the medial side.

As also seen in FIGS. 4A and 4B, some of the strips of fiber-reinforced layer 220 merge to form larger strips. For example, lateral side strips 221*i* and 221*j* merge toward the bottom of upper 2. The merged strip is bounded by gaps 222*h* and 222*j*. As another example, medial side strips 262*e* and 262*f* merge to form a larger strip bounded by gaps 263*d* and 263*f*. To avoid confusing the drawings with unnecessary detail, larger strips formed by merger of other strips are not separately marked.

The orientations of strips 221 generally correspond to lines of force imposed during various types of side-to-side motions in which a wearer of shoe 201 may be expected to engage. For example strip 221*a* is angled rearward, strip 221*o* is angled forward, and the orientations of strips 221*b* through 221*n* progressively vary from a rearwardly angled orientation in the front portion of upper 202 to a forwardly angled orientation in the rear portion of the upper 202.

Figure 5A:
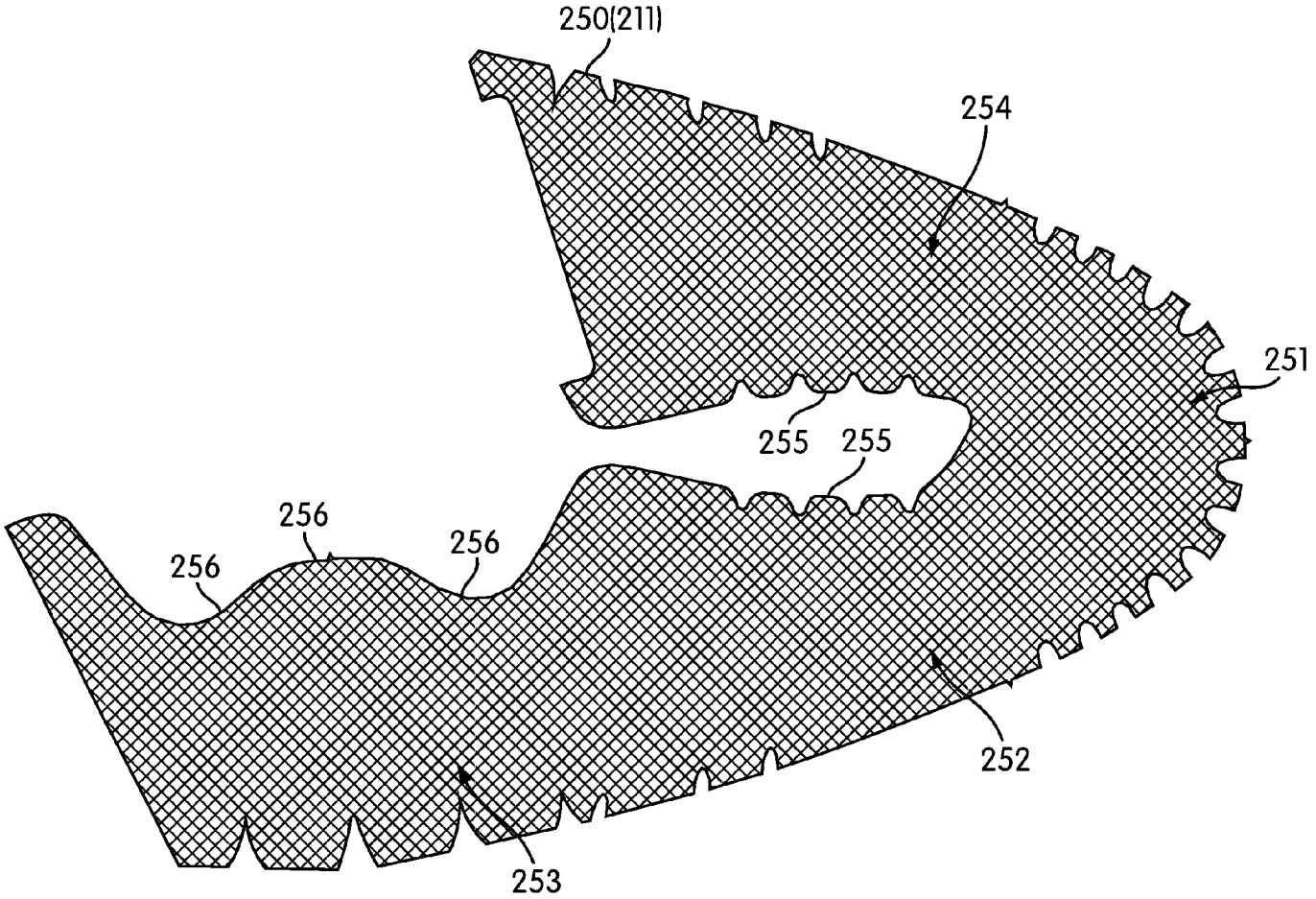
FIGS. 5A through 5C show assembly of components forming a composite shell of the upper incorporated into the shoe of FIGS. 4A and 4B.
Figure 5B:
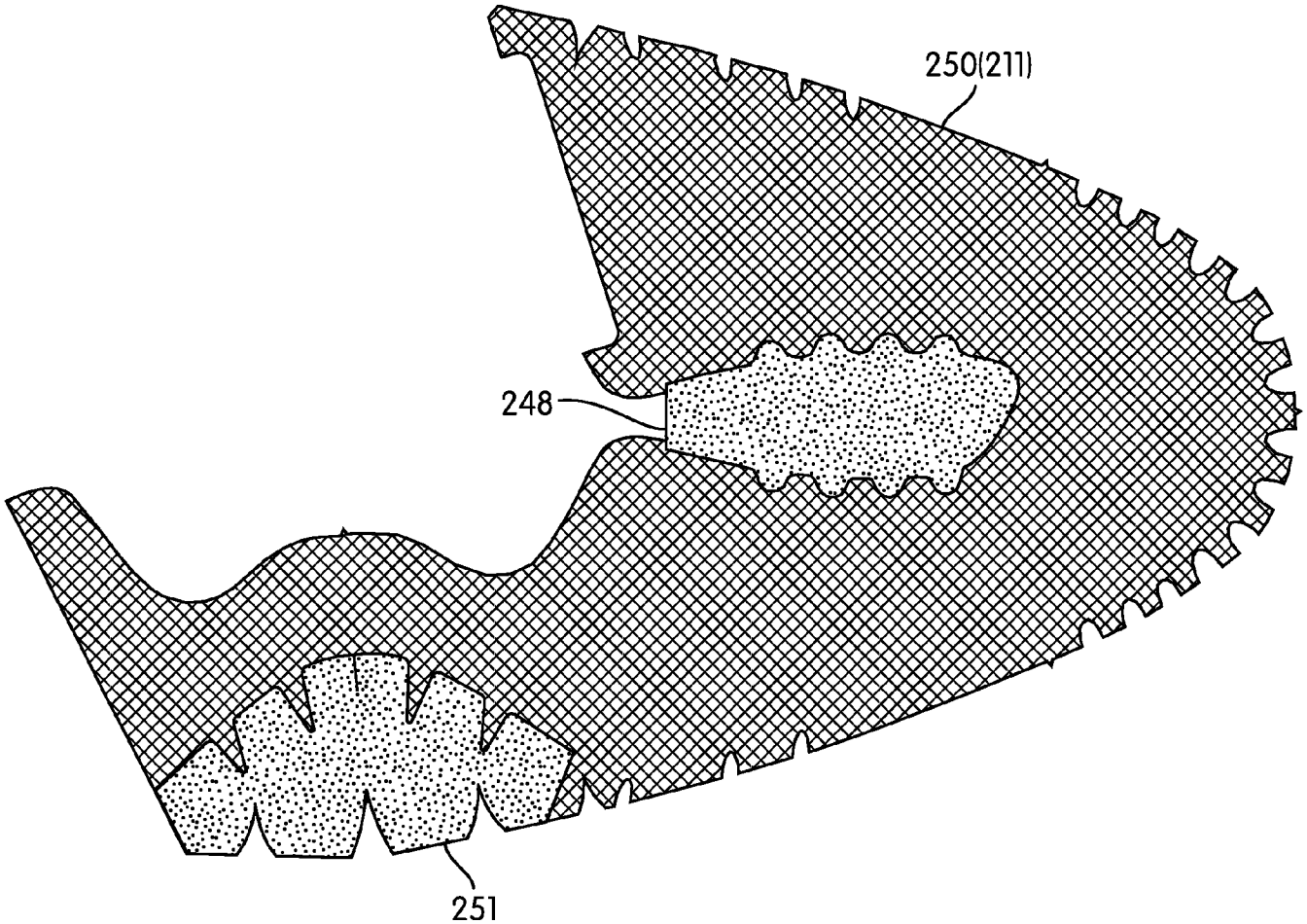
Figure 5C:
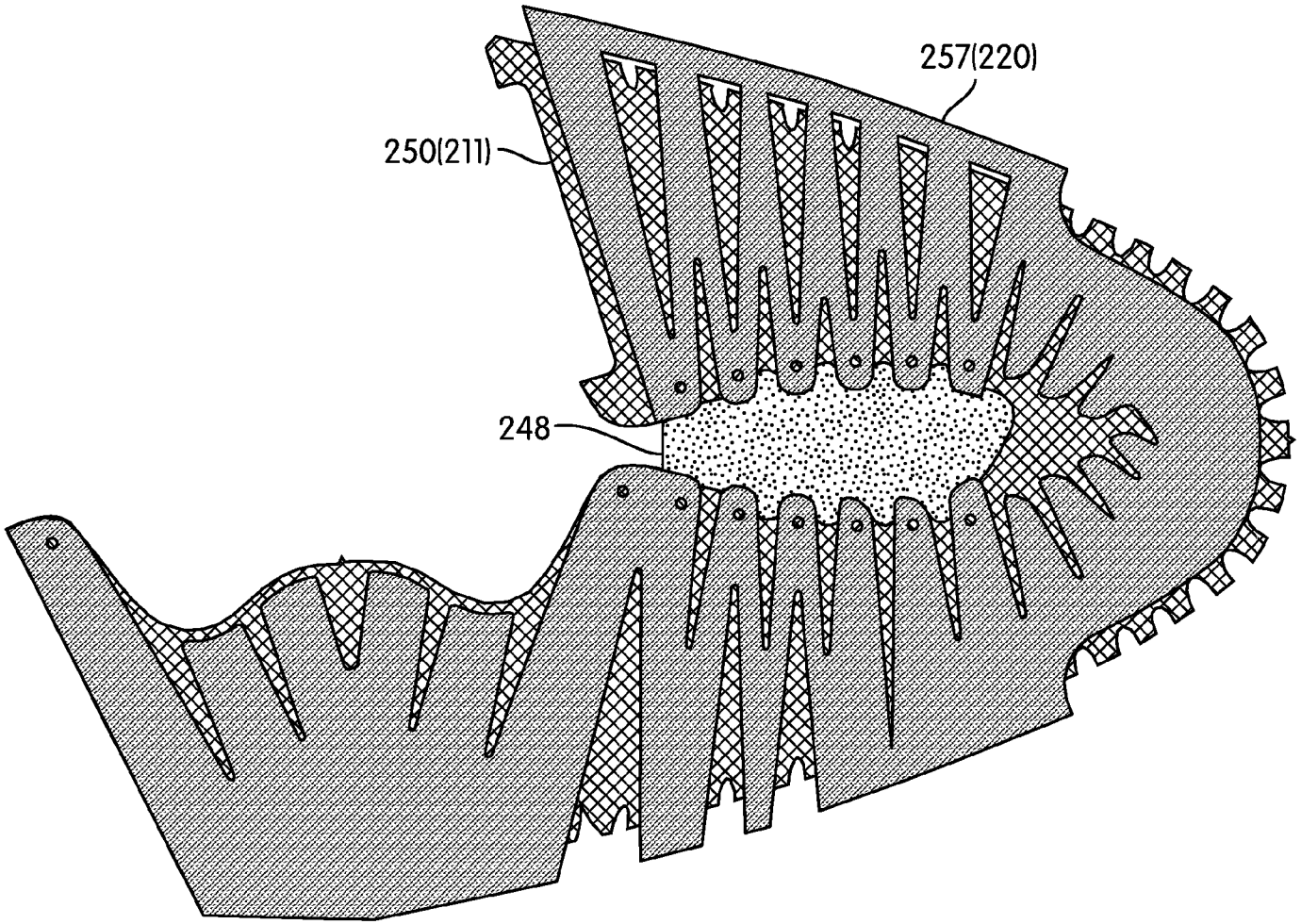

FIGS. 5A through 5C show assembly of the shell 210 components according to at least some embodiments. FIG. 5A shows a panel of material 250 that will form base layer 211. In at least some embodiments, the material of panel 250 is a textile mesh similar to that used for panel 50. In the embodiment of upper 202, panel 250 is a continuous single piece of material. In particular, the panel 250 material is continuously knitted and may be cut from a larger piece of the continuously knitted textile mesh.

The exterior face of panel 250 is shown in FIG. 5A. For purposes of reference, FIG. 5A further indicates certain regions of panel 250. A region 251 will become part of the toe region in upper 202. A region 252 will become part of the lateral forefoot side region of upper 202. A region 253 will become part of the rear of upper 202. A region 254 will become part of the medial forefoot side region of upper 202. An edge 255 will generally correspond to tongue opening 207. An edge 256 will generally correspond to ankle opening 204.

FIG. 5B shows panel 250 after placement of a panel 251 that will form a supplemental counter reinforcement. Panel 251 is placed on the exterior face of panel 250 in a region that will correspond to a heel region of upper 202 and will become a counter reinforcement. Panel 248 is placed over the opening in panel 250 that will coincide with tongue opening 207. Panel 248 also extends a short distance beyond edge 255 and over the exterior face of panel 250. As shown in further detail below, a portion of panel 248 over tongue opening 207 will later be removed, with the remaining portion of panel 248 left to surround and reinforce the edge of tongue opening 207. In at least some embodiments, panels 251 and 248 are cut from one or more larger pieces of synthetic leather (e.g., 1.2 mm thick synthetic leather). A layer of low melt TPU may be interposed between the interior faces of panels 251 and 248 and the regions of the panel 250 exterior face contacted by one of those panels.

FIG. 5C shows the assembly of panels 248, 250 and 251 after placement of a panel that will form fiber-reinforced layer 220. In the embodiment of upper 202, fiber-reinforced layer 220 is formed using a single panel 257. Panel 257, which may be die-cut from a larger piece of material similar to that used for panels 57 and 58, is placed on portions of the exterior faces of panels 250, 251 and 248 in regions that will correspond to lateral forefoot, lateral midfoot, lateral heel, medial heel, medial midfoot and medial forefoot regions of upper 202.

Figure 6:
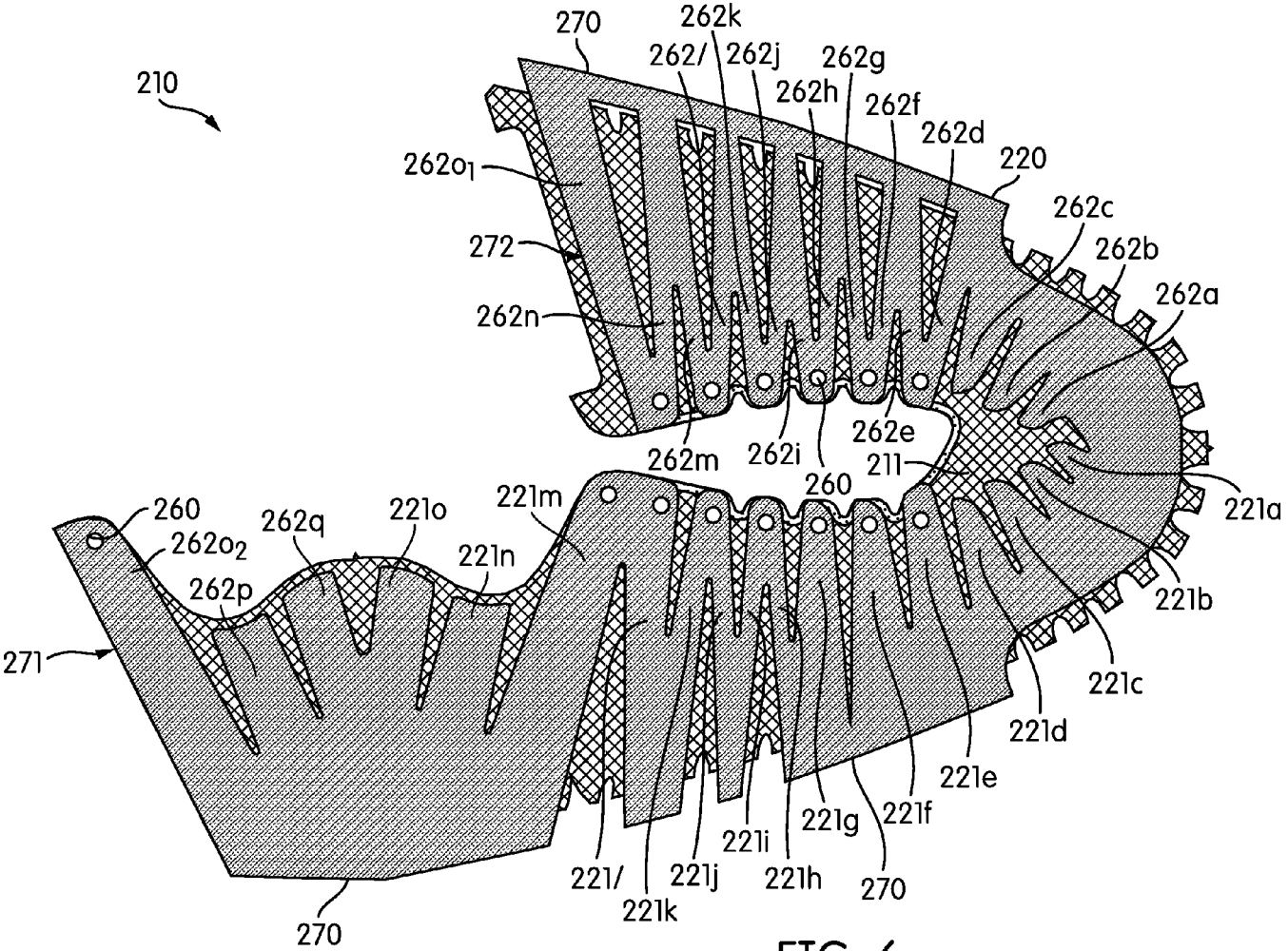
FIG. 6 shows a flattened composite shell prior to incorporation into the upper of the shoe of FIGS. 4A and 4B.

After completion of the panel assembly as shown in FIG. 5C, the assembly is subjected to pressing as described previously for the embodiment of upper 2. After that pressing, the bonded panel assembly is then trimmed to yield composite shell 210 in a flattened form. FIG. 6 shows that flattened composite shell 210 prior to incorporation into upper 202. For convenience, inter-strip gaps are not marked. A portion of panel 248 has been trimmed to expose tongue opening 207. Eyelet holes 260 have also been punched. To avoid obscuring FIG. 6, only a portion of eyelet holes 260 are indicated. In subsequent steps, additional components are attached to shell 210 so as to complete upper 202. Padded collar 205 is attached to the region of shell 210 that will form ankle collar 204. Tongue 206 is attached to the interior of shell 210 around the lower portion of tongue opening 207. Shell 210 is then folded from a flattened condition into a three-dimensional curved shape and edge 271 is joined to edge 272 using adhesive, stitching and/or another attachment technique. After folding over and securing of edges 271 and 272, strips 262$o_1$ and 262$o_2$ effectively become a single strip. The outer edge of a Strobel or other lasting element may then be stitched or otherwise secured to shell 210 near the lower edge base layer 211. The completed upper 202 may then be attached to sole structure 203 while upper 202 is secured to a last, with the bottom edges 270 of fiber-reinforced layer 220 folded under and placed between a bottom side of the lasting element and a top side of sole structure 203.

As with the embodiment of upper 2, fiber-reinforced layer 220 of shell 210 provides reinforced regions that cover a substantial portion of the exposed surface area of upper 202. In addition to providing shape to upper 202, this distribution of reinforcement over a wide surface area allows for greater comfort and support.

Figure 7:
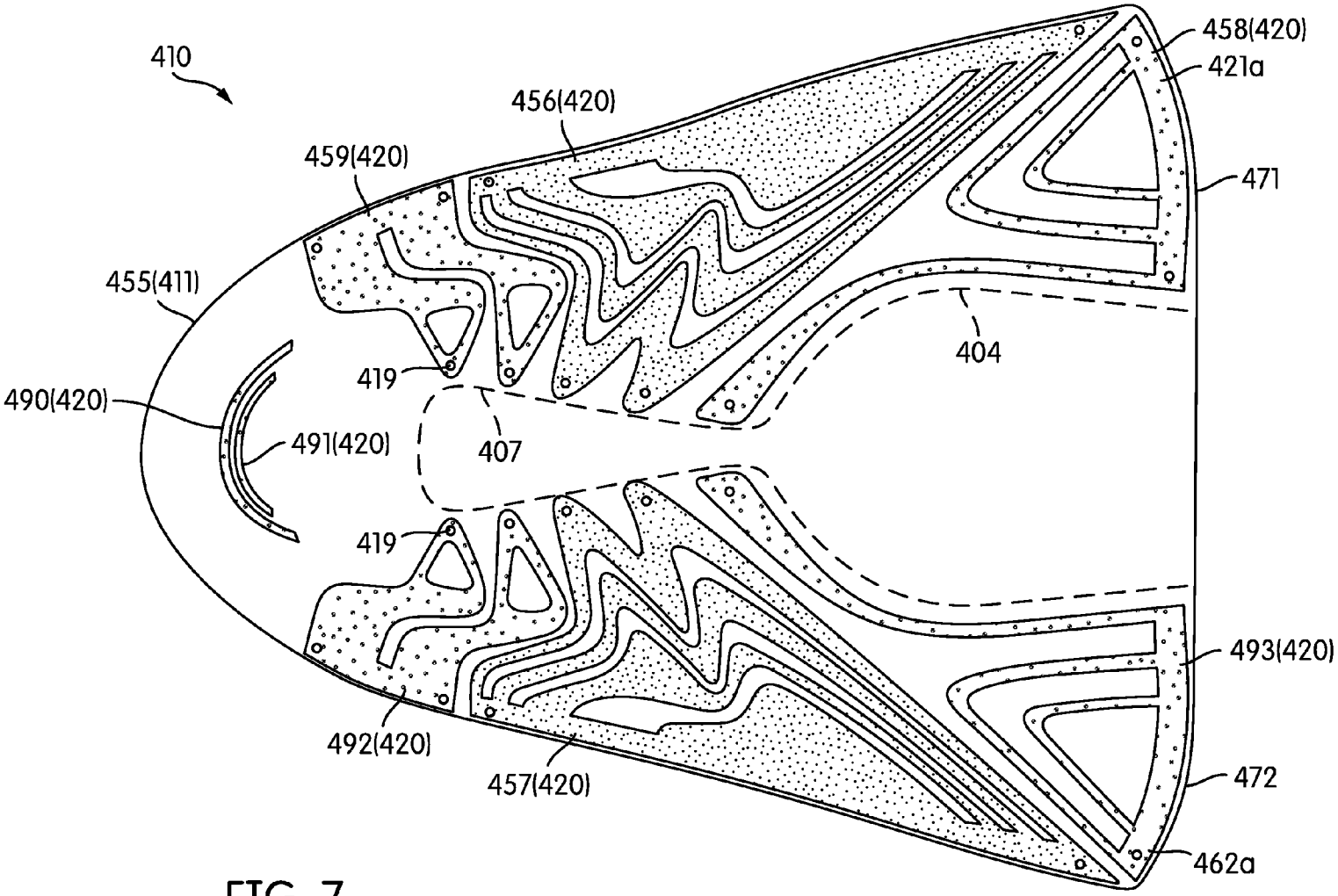
FIG. 7 shows a flattened composite shell prior to incorporation into an upper according to another embodiment.

FIG. 7 shows a flattened composite shell 410, according to certain additional embodiments, after pressing but prior to final trimming. Shell 410 includes a base layer 411 and a fiber-reinforce layer 420. Base layer 411 is formed from a panel 455 that was cut from a larger panel of a textile material (e.g., a knitted spacer mesh). Fiber-reinforced layer 420 is formed from panels of two different types of material. Panels 456 and 457 were cut from a first, fiber-reinforced, material. Panels 458, 459, 490, 491, 492 and 493 were cut from a second type of material. That second type of material may include fiber reinforcement in some embodiments. In other embodiments, that second type of material may lack fiber reinforcement. For example, panels 458, 459 and 490-493 could be panels of TPU or a TPU/PU composite, but may lack embedded fibers. To form shell 410, panels

456-459 and 490-493 were assembled on panel 455 in a manner similar to that previously described in connection with FIGS. 2A-2C and 5A-5C. The panel assembly was then subjected to heating and pressing as previously described.

Unlike shells 10 and 210, shell 410 may not include supplemental reinforcement in the tongue opening or heel regions. During final trimming, portions of panel 455 will be cut away to create a tongue opening 407 and an ankle opening 404. Edges of tongue opening 407 may then be secured by edge stitching or otherwise treated to prevent fraying. An ankle collar may then be sewn or otherwise attached to the edge of ankle opening 404. Lace eyelets may be punched in the locations of pilot holes 419 (for simplicity, only two of pilot holes 419 are marked in FIG. 7). Shell 410 may subsequently be folded from a flattened condition into a three-dimensional curved shape and edge 471 joined to edge 472 using adhesive, stitching and/or another attachment technique. After folding over and securing of edges 471 and 472, strips 421*a* and 462*a* effectively become a single strip located in the center of a rear heel region (similar to the location of strip 61 in the embodiment of upper 2). The outer edge of a Strobel or other lasting element may then be stitched or otherwise secured to shell 410 near the lower edge base of layer 411. The completed upper incorporating shell 410 may then be attached to a sole structure while the upper is secured to a last.

Figure 8:
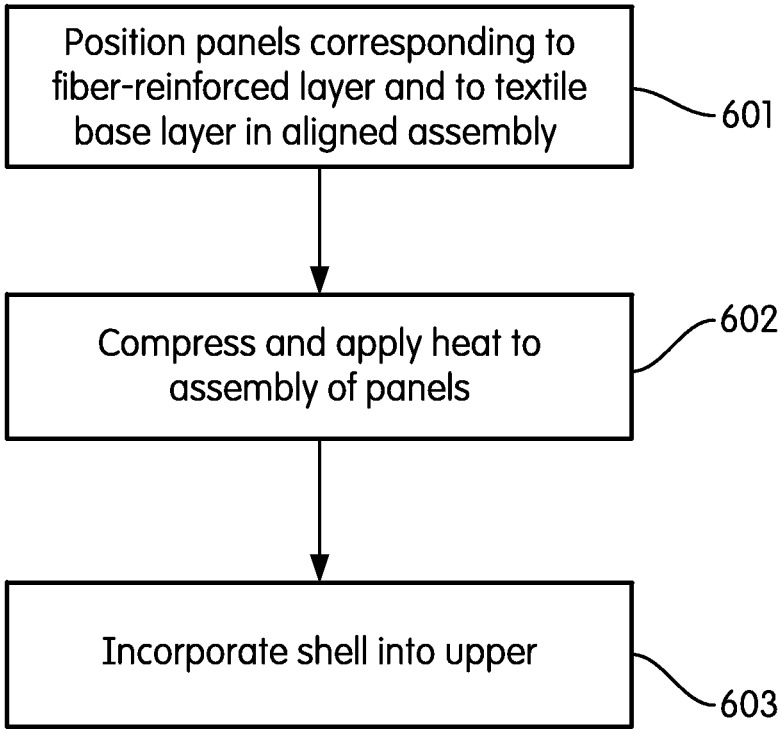
FIG. 8 is a flow chart showing steps of a method for fabricating an upper according to at least some embodiments.

FIG. 8 is a flow chart showing steps of a method for fabricating an upper according to at least some embodiments. In step 601, panels corresponding to a fiber-reinforced layer and to a textile base layer are positioned in an aligned assembly. One or more additional elements (e.g., panels corresponding to supplemental counter, toe and/or other supports) may also be positioned in the assembly during step 601. In step 602, the assembly is compressed and heat applied so as to bond the panels and form a flattened composite shell. In step 603, the composite shell is incorporated into an upper. As part of step 603, the composite shell may be folded into a complex three-dimensional shape and one edge of the shell secured to another edge of the shell so as to maintain that three-dimensional shape. In a subsequent step not shown in FIG. 8, the upper may be incorporated into an article of footwear or other foot-receiving device by attaching the upper to a sole structure or to another foot-receiving device element (e.g., to a blade of an ice skate).

Uppers 2 and 202, an upper incorporating shell 410, shoes incorporating these uppers, and the fabrication operations described herein are merely examples of products and processes according to some embodiments. Other embodiments include numerous other materials and material combinations. In some embodiments, for example, an upper may include additional material layers. In still other embodiments, an upper could include fewer material layers (e.g., supplemental support panels could be omitted). In some embodiments, additional linings may be added to an upper, while other embodiments lack a lining (e.g., there may be no padding or other lining extending downward from the padded portion of the ankle collar. Other embodiments may also include different shapes and/or arrangements of various components. Fiber-reinforced layer strips and inter-strip gaps may have numbers, shapes, orientations and/or locations other than as shown in the drawings and have different external appearances. Strips needed not be externally visible on a completed upper. All portions of a fiber-reinforcing layer need not be formed from the same type of composite. For example, a lateral side panel might be cut from a material comprising a first type of reinforcing fiber bound in a first polymer matrix. A medial side panel could be cut from a material comprising a second type of reinforcing fiber (different from the first type of fiber) bound in a second polymer (different from the first polymer) matrix. A single fiber-reinforcing layer panel may comprise multiple types and/or layers of reinforcing fibers. As indicated above, reinforcing fibers may comprise any of numerous types of materials.

In at least some embodiments, and as described above, shells may be formed by pressing assembled panels between two silicone pads, and by then performing a second pressing between unheated silicone pads. In this manner, fiber-reinforced layer panel(s) may conform to the base layer material so as to reveal a contour of the base layer material in the exterior surface of the fiber-fiber-reinforced layer panel(s). By providing fiber-reinforced layer region(s) that have a texture revealing an underlying base layer material, a potential purchaser of a shoe may be made aware of the structure of the shoe upper. Moreover, it is believed that the conformal nature of the contact between fiber-reinforced layer panel(s) and underlying base layer material(s) helps to increase the bonded surface areas and overall material strength.

In some embodiments, an additional material layer may be included over some or all of the exterior surface of a fiber-reinforced layer. For example, an additional panel of TPU or other polymer could be placed on top a fiber-reinforced panel during the panel assembly process. The additional panel may cover all of fiber-reinforced panel or may only cover a subportion of the fiber-reinforced panel. The additional panel may also extend over one or more edges of the fiber-reinforced panel and cover a region of the base layer panel or of other panels. That additional panel, upon pressing, would then bond to the fiber-reinforced panel and to any adjacent material panel covered by the additional panel. Use of additional panels in this manner may help provide supplemental securing of the fiber-reinforced panel to the base layer material. For example, the edges of a fiber-reinforced panels may be covered and a smoother transition to the base layer may be achieved. Moreover, some types of fiber-reinforced panel material may have sharp edges than can be covered by an additional panel.

In some embodiments, all portions of a fiber-reinforced panel may not be bonded to a base layer. For example, in some embodiments some or all strips corresponding to lacing eyelets may remain unattached so as to facilitate a more adaptive adjustment of upper fit to a wearer foot. Examples of such strips that might be left unattached along some or all of their length include one or more of the following strips or strip pairs of upper 2: 21*c* and 21*d*, 21*g* and 21*h*, 21*k* and 21*l*, 21*n* and 21*o*, 21*q* and 21*r*, 21*s* and 21*t*, 62*c* and 62*d*, 62*g* and 62*h*, 62*k* and 62*l*, 62*n* and 62*o*, 62*q* and 62*r*, 62*s* and 62*t*. Portions of a fiber-reinforced panel may left unbonded by omitting the TPU or other low-melting material from the interior faces of the panel portions that are to remain unbonded, or by interposing pieces of release paper between the base layer panel and the interior faces of the fiber-reinforced panel portions that are to remain unbonded.

As seen in the drawings, uppers according to at least some embodiments include a fiber-reinforced layer that covers a substantial portion of the upper surface area above the footbed. In some embodiments, at least 50% of the upper surface area in the forefoot regions rearward of the toes, above the footbed and below a tongue opening, and in the midfoot regions above the footbed, are covered by at least five fiber-reinforced strips on each of the medial and lateral sides. In other embodiments, that coverage may be at least 60%, 65%, 70%, 75%, or more. In any of these embodiments, the number of fiber-reinforced strips on each of the medial and lateral sides may be at least 10, at least 15, at least 20, or more.

In some embodiments, a composite shell formed using techniques similar to those described above might not form an entire upper. As but one example, a substantially flat composite element comprising a base and fiber-reinforced layer might only correspond to a portion of an upper shell (e.g., to the front of an upper). That composite element might then be joined to one or more other components that will form the remaining portions of the upper shell (e.g., in the heel region). Those other components could be formed by processes similar to those described above or by different processes.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

The invention claimed is:

1. An upper comprising:

a textile base layer extending over sides of a generally foot-shaped interior region, the textile base layer including an outer edge, tongue opening edges, and ankle opening edges, the textile base layer further including an exterior face extending between the outer edge and the tongue opening edges and between the outer edge and the ankle opening edges; and a fiber-reinforced layer comprising a first panel, the first panel being a continuous and seamless single piece of composite material that includes reinforcing fibers bound in a polymer matrix, the first panel including an interior face, and wherein at least portions of the interior face of the first panel are bonded to portions of the exterior face of the textile base layer by penetration of solidified bonding material forming those bonded portions of the interior face of the first panel into interstices of the exterior face, wherein the first panel includes portions located in lateral forefoot, lateral midfoot, lateral heel, and medial heel regions of the upper, the first panel further including a portion extending from the lateral heel region and across a central heel region to the medial heel region, the first panel includes a plurality of strips, the strips separated by and defining inter-strip gaps in the first panel, the strips distributed across the lateral forefoot, the lateral midfoot, the lateral heel, and the medial heel regions, and the first panel includes a central strip extending upwardly along the central heel region, and a plurality of strips branch outwardly and upwardly from the central strip toward the lateral heel region and a plurality of strips branch outwardly and upwardly from the central strip toward the medial heel region.

2. The upper of claim 1, wherein the base layer comprises a stretchable textile material.

3. The upper of claim 1, wherein the reinforcing fibers comprise a non-stretchable fiber material.

4. The upper of claim 1, wherein the base layer comprises a knitted mesh.

5. The upper of claim 1, wherein the reinforcing fibers comprise at least one of woven polyester fibers and woven polyamide fibers bound in the polymer matrix.

6. The upper of claim 1, wherein the reinforcing fibers comprise at least one of glass fibers and carbon fibers bound in the polymer matrix.

7. The upper of claim 1, wherein the base layer comprises a continuous single-piece knitted element.

8. The upper of claim 1, wherein the fiber-reinforced layer comprises a second panel, the second panel being a single sheet of composite material that includes reinforcing fibers bound in a polymer matrix, the second panel includes an interior face, at least portions of the interior face of the second panel being bonded to different portions of the exterior face of the textile base layer, and the second panel comprises a plurality of second strips separated by and defining second inter-strip gaps in the second panel, the second strips distributed across a medial forefoot region of the upper, a medial midfoot region of the upper, and the medial heel region.

9. The upper of claim 8, wherein the strips have orientations that progressively vary from a rearwardly angled orientation in a front portion of the upper to a forwardly angled orientation in a rear portion of the upper.

10. An article of footwear comprising:

the upper of claim 1; and a sole structure joined to the upper.

11. The upper of claim 9, wherein the second strips have orientations that progressively vary from a rearwardly angled orientation in a front portion of the upper to a forwardly angled orientation in a rear portion of the upper.

12. An upper comprising:

a textile base layer extending over sides of a generally foot-shaped interior region, the textile base layer including an outer edge, tongue opening edges, and ankle opening edges, the textile base layer further including an exterior face extending between the outer edge and the tongue opening edges and between the outer edge and the ankle opening edges; and a fiber-reinforced layer comprising first and second panels, each of the first and second panels being a single seamless and continuous piece of composite material that includes reinforcing fibers bound in a polymer matrix, wherein the first panel includes an interior face, at least portions of the interior face of the first panel being bonded to portions of the exterior face of the textile base layer, the second panel includes an interior face, at least portions of the interior face of the second panel being bonded to different portions of the exterior face of the textile base layer, the first panel includes portions located in lateral forefoot, lateral midfoot, lateral heel, and medial heel regions of the upper and extends from the outer edge of the base layer to a top portion of the base layer generally corresponding to part of an instep region and to part of an ankle opening region, the first panel includes a plurality of first strips, the first strips separated by and defining first inter-strip gaps in the first panel, the first strips distributed across the lateral forefoot, the lateral midfoot, the lateral heel, and the medial heel regions, the first panel includes a central strip extending upwardly along a central heel region, and a plurality of strips branch outwardly and upwardly from the central strip toward the lateral heel region and a plurality of strips branch outwardly and upwardly from the central strip toward the medial heel region, and the second panel comprises a plurality of second strips separated by and defining second inter-strip gaps in the second panel, the second strips distributed across a medial forefoot region of the upper, a medial midfoot region of the upper, and the medial heel region.

13. The upper of claim 12, wherein the reinforcing fibers comprise at least one of woven polyester fibers, woven polyamide fibers, glass fibers, and carbon fibers.

14. The upper of claim 1, wherein the upper extends from a bottom portion of the base layer corresponding to a footbed perimeter to a top portion of the base layer corresponding to part of an instep region and to part of an ankle opening region.

15. The upper of claim 1, wherein the first panel includes a portion extending continuously along the outer edge in the lateral forefoot, the lateral midfoot, the lateral heel, the central heel, and the medial heel regions.

16. The upper of claim 1, wherein, as to each of a plurality of the inter-strip gaps, two of the strips defining the inter-strip gap of the plurality are joined at bottom ends of those strips by a portion of the first panel adjacent the outer edge and are unjoined at top ends of those strips located in the lateral forefoot region near one of the tongue opening edges, the inter-strip gap of the plurality extends continuously, from the bottom ends of the two of the strips defining the inter-strip gap of the plurality, to the top ends of the two of the strips defining the inter-strip gap of the plurality, and the inter-strip gap of the plurality is open at the top ends of the two of the strips defining the inter-strip gap of the plurality.

17. The upper of claim 1 wherein, as to each of a plurality of the inter-strip gaps, two of the strips defining the inter-strip gap of the plurality are joined at bottom ends of those strips by a portion of the first panel adjacent the outer edge and are unjoined at top ends of those strips located in the lateral midfoot region near one of the tongue opening edges, the inter-strip gap of the plurality extends continuously, from the bottom ends of the two of the strips defining the inter-strip gap of the plurality, to the top ends of the two of the strips defining the inter-strip gap of the plurality, and the inter-strip gap of the plurality is open at the top ends of the two of the strips defining the inter-strip gap of the plurality.

18. The upper of claim 1 wherein, as to each of a plurality of the inter-strip gaps, two of the strips defining the inter-strip gap of the plurality are joined at bottom ends of those strips by a portion of the first panel adjacent the outer edge in the lateral heel region and are unjoined at top ends of those strips located in the lateral midfoot region near one of the tongue opening edges, the inter-strip gap of the plurality extends continuously, from the bottom ends of the two of the strips defining the inter-strip gap of the plurality, to the top ends of the two of the strips defining the inter-strip gap of the plurality, and the inter-strip gap of the plurality is open at the top ends of the two of the strips defining the inter-strip gap of the plurality.

19. The upper of claim 1, wherein, as to each of a first plurality of the inter-strip gaps, two of the strips defining the inter-strip gap of the first plurality are joined at bottom ends of those strips by a portion of the first panel adjacent the outer edge and are unjoined at top ends of those strips located in the lateral forefoot region near one of the tongue opening edges, the inter-strip gap of the first plurality extends continuously, from the bottom ends of the two of the strips defining the inter-strip gap of the first plurality, to the top ends of the two of the strips defining the inter-strip gap of the first plurality, and the inter-strip gap of the first plurality is open at the top ends of the two of the strips defining the inter-strip gap of the first plurality, and as to each of a second plurality of the inter-strip gaps, two of the strips defining the inter-strip gap of the second plurality are joined at bottom ends of those strips by a portion of the first panel adjacent the outer edge and are unjoined at top ends of those strips located in the lateral midfoot region near one of the tongue opening edges, the inter-strip gap of the second plurality extends continuously, from the bottom ends of the two of the strips defining the inter-strip gap of the second plurality, to the top ends of the two of the strips defining the inter-strip gap of the second plurality, and the inter-strip gap of the second plurality is open at the top ends of the two of the strips defining the inter-strip gap of the second plurality, and as to each of a third plurality of the inter-strip gaps, two of the strips defining the inter-strip gap of the third plurality are joined at bottom ends of those strips by a portion of the first panel adjacent the outer edge in the lateral heel region and are unjoined at top ends of those strips located in the lateral midfoot region near one of the tongue opening edges, the inter-strip gap of the third plurality extends continuously, from the bottom ends of the two of the strips defining the inter-strip gap of the third plurality, to the top ends of the two of the strips defining the inter-strip gap of the third plurality, and the inter-strip gap of the third plurality is open at the top ends of the two of the strips defining the inter-strip gap of the third plurality.

20. The upper of claim 8, wherein, as to each of a plurality of the second inter-strip gaps, two of the second strips defining the second inter-strip gap of the plurality are joined at bottom ends of those second strips by a portion of the second panel adjacent the outer edge and are unjoined at top ends of those second strips located in the medial forefoot region near one of the tongue opening edges, the second inter-strip gap of the plurality extends continuously, from the bottom ends of the two of the second strips defining the second inter-strip gap of the plurality, to the top ends of the two of the second strips defining the second inter-strip gap of the plurality, and the second inter-strip gap of the plurality is open at the top ends of the two of the second strips defining the second inter-strip gap of the plurality.

21. The upper of claim 8, wherein, as to each of a plurality of the second inter-strip gaps, two of the second strips defining the second inter-strip gap of the plurality are joined at bottom ends of those second strips by a portion of the second panel adjacent the outer edge and are unjoined at top ends of those second strips located in the medial midfoot region near one of the tongue opening edges, the second inter-strip gap of the plurality extends continuously, from the bottom ends of the two of the second strips defining the second inter-strip gap of the plurality, to the top ends of the two of the second strips defining the second inter-strip gap of the plurality, and the second inter-strip gap of the plurality is open at the top ends of the two of the second strips defining the second inter-strip gap of the plurality.

22. The upper of claim 8, wherein, as to each of a plurality of the inter-strip gaps, two of the strips defining the inter-strip gap of the plurality are joined at bottom ends of those strips by a portion of the first panel adjacent the outer edge in the medial heel region and are unjoined at top ends of those strips located in the medial midfoot region near one of the tongue opening edges, the inter-strip gap of the plurality extends continuously, from the bottom ends of the two of the strips defining the inter-strip gap of the plurality, to the top ends of the two of the strips defining the inter-strip gap of the plurality, and the inter-strip gap of the plurality is open at the top ends of the two of the strips defining the inter-strip gap of the plurality.

23. The upper of claim 8, wherein, as to each of a first plurality of the second inter-strip gaps, two of the second strips defining the second inter-strip gap of the first plurality are joined at bottom ends of those second strips by a portion of the second panel adjacent the outer edge and are unjoined at top ends of those second strips located in the medial forefoot region near one of the tongue opening edges, the second inter-strip gap of the first plurality extends continuously, from the bottom ends of the two of the second strips defining the second inter-strip gap of the first plurality, to the top ends of the two of the second strips defining the second inter-strip gap of the first plurality, and the second inter-strip gap of the first plurality is open at the top ends of the two of the second strips defining the second inter-strip gap of the first plurality, and as to each of a second plurality of the second inter-strip gaps, two of the second strips defining the second inter-strip gap of the second plurality are joined at bottom ends of those second strips by a portion of the second panel adjacent the outer edge and are unjoined at top ends of those second strips located in the medial midfoot region near one of the tongue opening edges, the second inter-strip gap of the second plurality extends continuously, from the bottom ends of the two of the second strips defining the second inter-strip gap of the second plurality, to the top ends of the two of the second strips defining the second inter-strip gap of the second plurality, and the second inter-strip gap of the second plurality is open at the top ends of the two of the second strips defining the second inter-strip gap of the second plurality, and as to each of a plurality of the inter-strip gaps, two of the strips defining the inter-strip gap of the plurality are joined at bottom ends of those strips by a portion of the first panel adjacent the outer edge in the medial heel region and are unjoined at top ends of those strips located in the medial midfoot region near one of the tongue opening edges, the inter-strip gap of the plurality extends continuously, from the bottom ends of the two of the strips defining the inter-strip gap of the plurality, to the top ends of the two of the strips defining the inter-strip gap of the plurality, and the inter-strip gap of the plurality is open at the top ends of the two of the strips defining the inter-strip gap of the plurality.

24. The upper of claim 1, wherein the bonding material comprises thermoplastic polyurethane.

25. The upper of claim 1, wherein the first panel comprises lacing eyelets located at top ends of a plurality of the strips, and wherein each of the strips of the plurality is not bonded to the exterior face of the base layer.

26. The upper of claim 13, wherein the base layer comprises a continuous single-piece knitted element.

27. The upper of claim 26, wherein at least portions of the interior face of the first panel are bonded to portions of the exterior face of the textile base layer by penetration of solidified bonding material forming those bonded portions of the interior face of the first panel into interstices of the exterior face.

28. The upper of claim 27, wherein the first panel comprises lacing eyelets located at top ends of a plurality of the strips, and wherein each of the strips of the plurality is not bonded to the exterior face of the base layer.

* * * * *